US010095158B1

(12) United States Patent
Yamamoto et al.

(10) Patent No.: US 10,095,158 B1
(45) Date of Patent: Oct. 9, 2018

(54) IMAGE FORMING APPARATUS

(71) Applicant: Brother Kogyo Kabushiki Kaisha, Nagoya (JP)

(72) Inventors: Tomoya Yamamoto, Kasugai (JP); Masahito Saeki, Nagoya (JP); Tomoyuki Mizuno, Nagoya (JP); Hideaki Yoshimune, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/911,499

(22) Filed: Mar. 5, 2018

(30) Foreign Application Priority Data

May 17, 2017 (JP) ..... 2017-097800

(51) Int. Cl.

| | |
|---|---|
| ***G03G 15/08*** | (2006.01) |
| ***G03G 15/04*** | (2006.01) |
| ***G03G 15/00*** | (2006.01) |
| ***G03G 21/18*** | (2006.01) |

(52) U.S. Cl.
CPC ..... *G03G 15/0832* (2013.01); *G03G 15/04* (2013.01); *G03G 15/6511* (2013.01); *G03G 21/18* (2013.01)

(58) Field of Classification Search
CPC ..... G03G 15/0832; G03G 15/04; G03G 15/6511; G03G 21/18
See application file for complete search history.

(56) References Cited

U.S. PATENT DOCUMENTS

2010/0158575 A1* 6/2010 Maeshima ..... G03G 15/0875 399/262
2013/0170872 A1* 7/2013 Buchanan ..... G03G 15/0832 399/262
2015/0030355 A1* 1/2015 Eto ..... G03G 15/0865 399/258
2015/0331386 A1* 11/2015 Tanaami ..... G03G 21/1666 399/110
2017/0267473 A1* 9/2017 Watanabe ..... B65H 5/36

FOREIGN PATENT DOCUMENTS

JP 05249820 A * 9/1993
JP 2000275940 A * 10/2000
JP 2006-194913 A 7/2006

* cited by examiner

*Primary Examiner* — Francis C Gray
(74) *Attorney, Agent, or Firm* — Burr & Brown, PLLC

(57) ABSTRACT

A cartridge of an image forming apparatus includes a conveying member configured to convey toner from a tonner accommodating part of the cartridge to a developing device, and a switching lever configured to switch a state of the conveying member between a driven state and a non-driven state. The toner replenishment lever is movable between a first position at which the replenishment lever pushes the switching lever and a second position at which the replenishment lever is spaced from the switching lever. The contacting part is retracted to outside of a space through which the cartridge passes when attached to or detached from the attachment position. The switching lever is configured to switch the state of the conveying member between the driven state and the non-driven state depending on whether the contacting part of the toner replenishment lever is located at the first position or the second position.

7 Claims, 20 Drawing Sheets

IMAGE FORMING APPARATUS

CROSS-REFERENCE TO RELATED APPLICATIONS

This application claims priority under 35 U.S.C. § 119 from Japanese Patent Application No. 2017-097800 filed on May 17, 2017. The entire subject matter of the application is incorporated herein by reference.

BACKGROUND

Technical Field

The present disclosures relate to an image forming apparatus.

Related Art

Conventionally, there has been known a cartridge type image forming apparatus which is configured such that a cartridge is detachably attached inside a casing of the image forming apparatus.

In the cartridge type image forming apparatus, typically, an opening is formed on a front surface of the casing, and a front door for opening/closing the opening is provided. When the front door is opened, the opening is exposed to outside. In this state, the cartridge can be inserted in the casing through the opening, and can be removed from the casing through the opening.

SUMMARY

There has also been known a cartridge which is configured to have two divided sections: a process unit which integrally includes a photosensitive drum and a developer roller applying toner to the photosensitive drum to form a toner image; and a toner box containing the toner. In the toner box, a conveying member configured to convey the toner toward a toner outlet. In the toner box, a conveying member to convey the toner to a toner outlet is provided. As the conveying member (e.g., an agitating member) rotates inside the toner box, the toner is conveyed from the toner outlet and supplied to the process unit.

When the cartridge is configured as described above, it is preferable that the agitating member is rotated when the toner is to be supplied to the process unit, while the agitating member is stopped when it is not necessary to supply the toner to the process unit. In order to achieve such an operation, input/cutoff of a driving force to a gear for rotating the agitating member should be switched.

As an exemplary configuration for switching the input/cutout of the driving force to the gear for rotating the agitating member, there is known a mechanism having a driving gear and a pendulum gear, the pendulum gear engaging with the driving gear and rotatably supported by a rockable arm which is rockable about a rotational axis of the driving gear. According to such a mechanism, depending on whether the driving gear is rotated forwardly or reversely, an engaging state of the pendulum gear with the gear to rotate the agitating member is switched between a connected state and a disconnected state.

If the above-described mechanism is employed in the cartridge type image forming apparatus, the pendulum gear may block attachment/detachment movement of the cartridge with respect the casing of the image forming apparatus.

In consideration of the above, the present disclosures provide an improved image forming apparatus configured to switch a driven state and a non-driven state of a conveying member which conveys toner with a configuration which does not block the attachment/detachment movement of the cartridge.

According to aspects of the disclosures, there is provided an image forming apparatus including a casing having a first opening on a side surface of the casing, a first frame and a second frame, both arranged inside the casing, a cartridge configured to be attached to and detached from, through the first opening, an attachment position defined between the first frame and the second frame, the first frame and the second frame facing each other across the attachment position, and a tonner replenishment lever provided to the first frame. The cartridge includes a photosensitive drum, a developing device accommodating a developing roller configured to supply toner onto a surface of the photosensitive drum a tonner accommodating part, a conveying member configured to convey the toner from the tonner accommodating part to the developing device, and a switching lever configured to switch a state of the conveying member between a driven state in which the conveying member conveys the toner, and a non-driven state in which the conveying member does not convey the toner. The toner replenishment lever further includes a contacting part, the toner replenishment lever being movable between a first position at which the contacting part pushes the switching lever and a second position at which the contacting part is spaced from the switching lever. When the toner replenishment lever is located at the second position, the contacting part is located outside a space through which the cartridge passes when the cartridge is attached to or detached from the attachment position. When the toner replenishment lever is located at the first position, the contacting part pushes the switching lever to switch the state of the conveying member from the non-driven state to the driven state, while when the toner replenishment lever is located at the second position, the contacting part is spaced from the switching lever to switch the state of the conveying member from the driven state to the non-driven state.

According to aspects of the present disclosures, there is provided an image forming apparatus including a casing having a first opening on a side surface of the casing, a first frame and a second frame, both arranged inside the casing, a cartridge configured to be attached to and detached from, through the first opening, an attachment position defined between the first frame and the second frame, the first frame and the second frame facing each other across the attachment position, and a tonner replenishment lever provided to the first frame. The cartridge includes a photosensitive drum, a developing device accommodating a developing roller configured to supply toner onto a surface of the photosensitive drum, a tonner accommodating part, a conveying member configured to convey the toner from the tonner accommodating part to the developing device, and a switching lever configured to switch a state of the conveying member between a driven state in which the conveying member conveys the toner, and a non-driven state in which the conveying member does not convey the toner. The toner replenishment lever further includes a contacting part, which is movable between a first position at which the contacting part pushes the switching lever and a second position at which the contacting part is spaced from the switching lever, the contacting part being retracted to outside of a space through which the cartridge passes when the cartridge is attached to or detached from the attachment position. When the contacting part is located at the first position, the contacting part pushes the switching lever to switch the state of the conveying member from the non-driven state to the driven state, and when the contacting part is located at the second position, the contacting part is spaced from the switching lever to switch the conveying member from the driven state to the non-driven state.

BRIEF DESCRIPTION OF THE ACCOMPANYING DRAWINGS

DETAILED DESCRIPTION OF THE EMBODIMENT

Hereinafter, referring to the accompanying drawings, an embodiment of the present disclosures will be described.

<Appearance of Printer>

Figure 1:
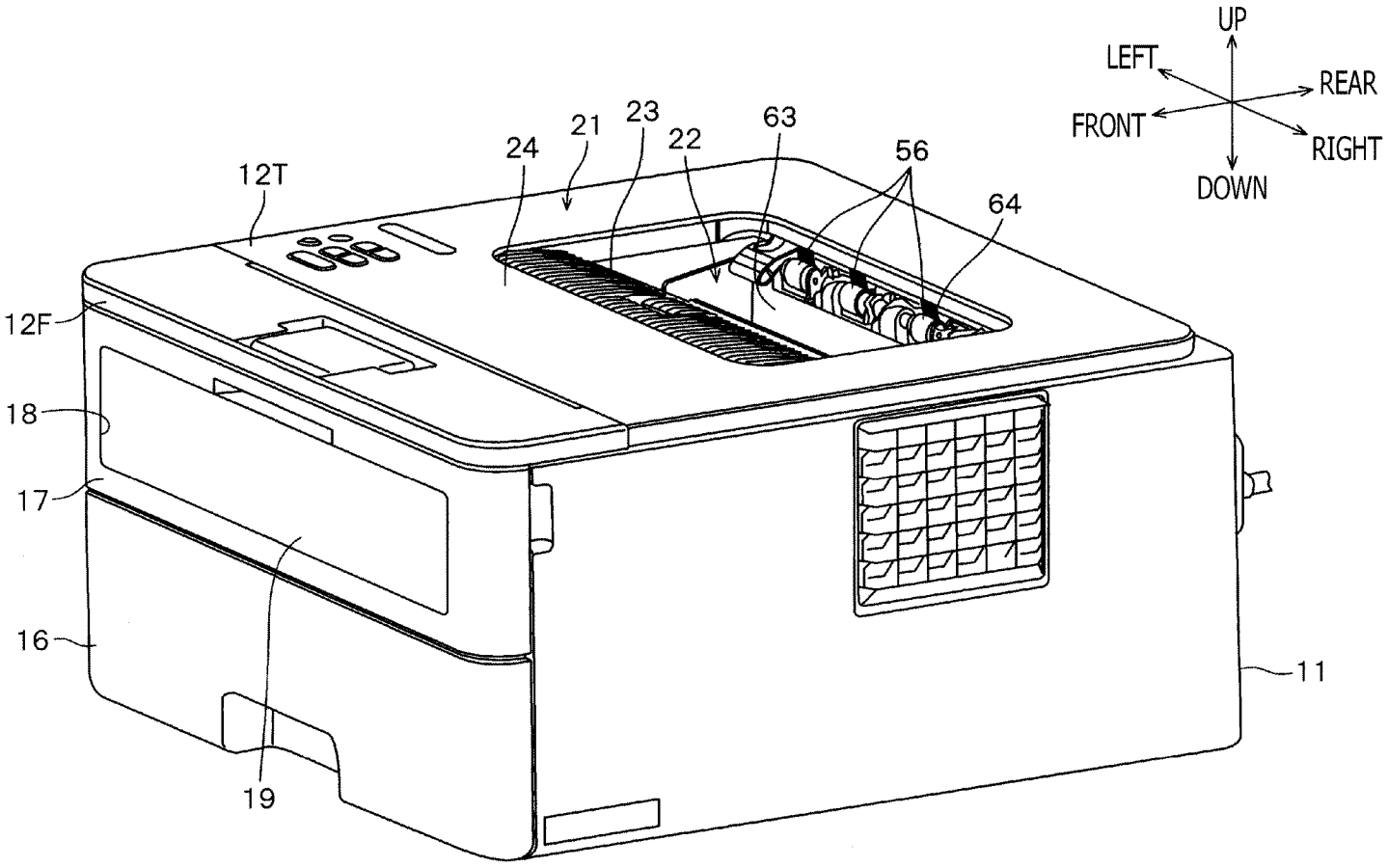
FIG. 1 is a perspective view of a printer according to an embodiment of the present disclosures, and shows a state where a front cover is located at an opening position.

FIG. 1 is a perspective view of a printer 1 according to an embodiment of the present disclosures. The printer 1 is a monochromatic laser printer, which is an example of an image forming apparatus.

Figure 2:
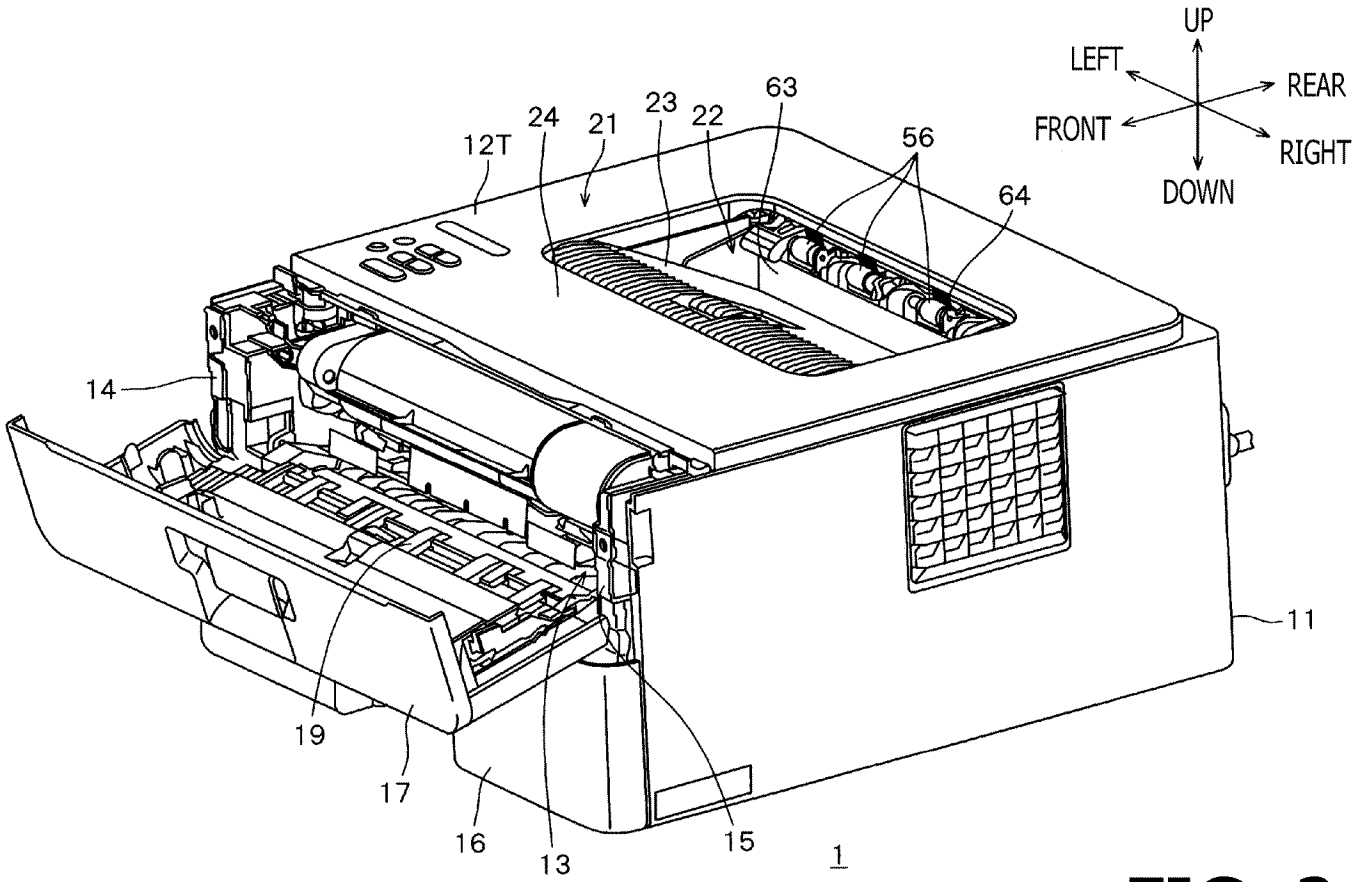
FIG. 2 is a perspective view of the printer and shows a state where the front cover is located at a closing position.

The printer 1 has a casing 11 configuring an outer appearance of the printer 1. The casing 11 has a substantially rectangular parallelepiped shape. The casing 11 has a first opening 13 which extends over on side surface 12F and an upper surface 12T as shown in FIG. 2.

Hereinafter, for the sake of description, front, rear, right and left sides are defined as follows. A side where the first opening 13 is defined as the front side of the printer, and an opposite side of the printer 1 is defined as the rear side. Thus, the side surface 12F is the front surface of the casing 11. When the printer 1 is viewed from the front side, the right and left sides of the printer 1 are defined as a right-hand side and a left-hand side, respectively. Arrows indicating the directions based on the above definition are indicated in each drawing.

Figure 3:
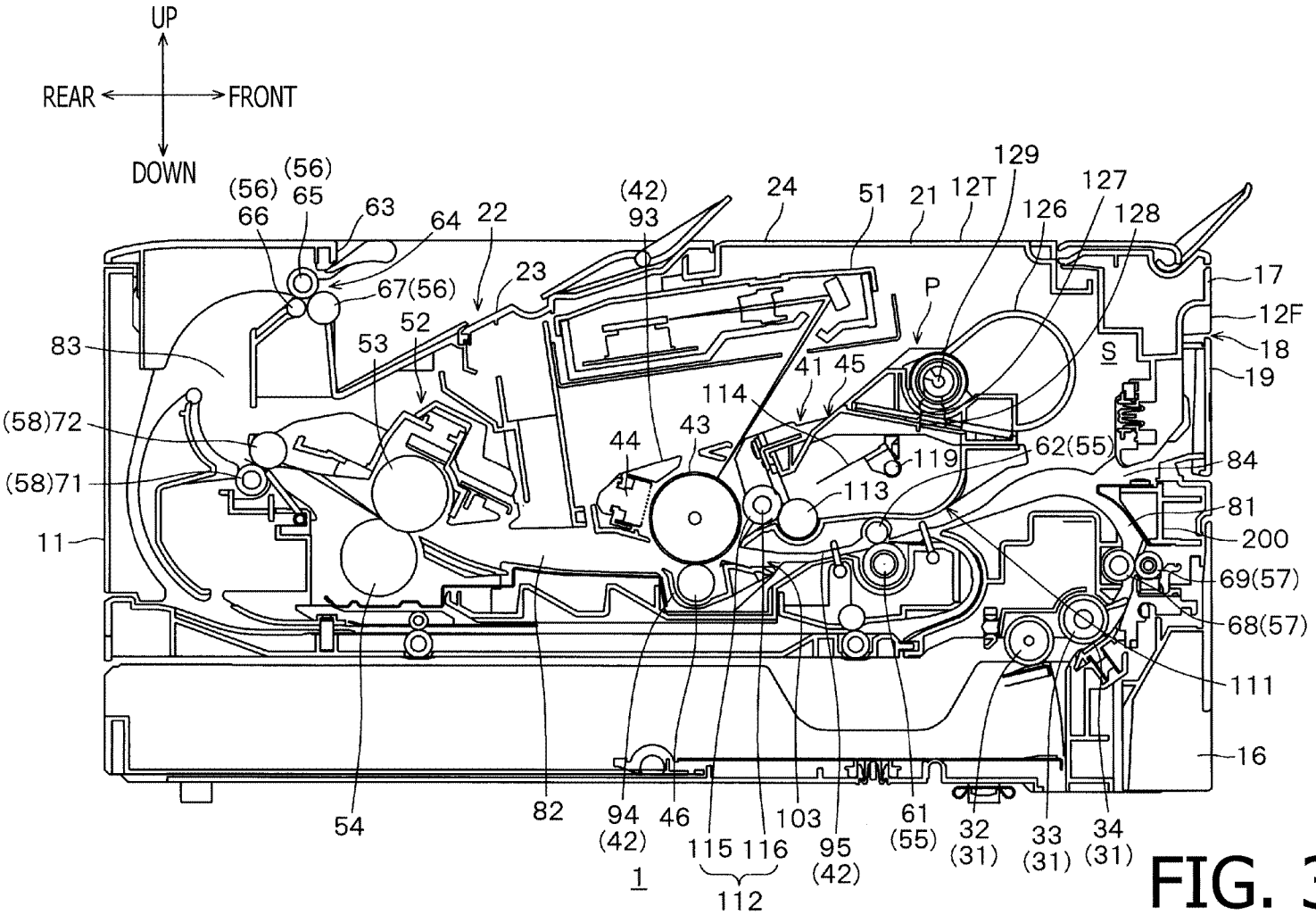
FIG. 3 is a cross-sectional side view of the printer.
Figure 4:
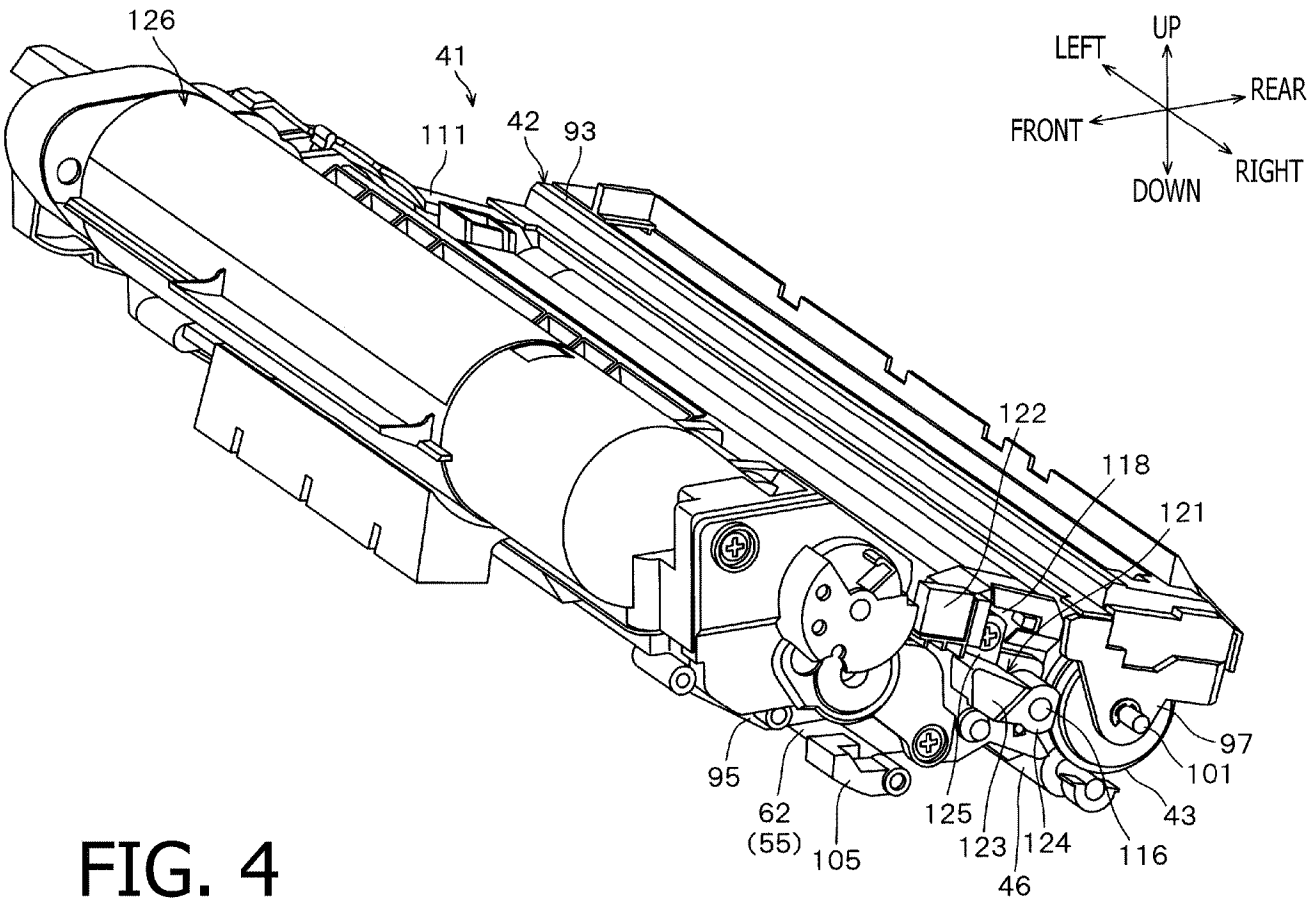
FIG. 4 is a perspective view of a process cartridge.

The casing 11 has a first frame 14 and a second frame 15, both made of resin. The first frame 14 is arranged on the left side with respect to the first opening 13 as shown in FIG. 3. The second frame 15 is arranged on the right side with respect to the first opening 13 as shown in FIG. 4. That is, the first frame 14 and the second frame 15 are arranged opposite to each other with the first opening 13 being located therebetween.

On a bottom part of the casing 11, the sheet feed tray 16 is removably inserted. In other words, at a lower part of a space defined between the first frame 14 and the second frame 15, an attachment position of the sheet feed tray 16 is defined. The sheet feed tray 16 is attached to the attachment position such that the sheet feed tray 16 can be drawn frontward from the attachment position. The sheet feed tray 16 is configured to support a plurality of sheets (e.g., printing sheets) in a stacked state.

Above a front end part of the sheet feed tray 16 attached to the attachment position, a front cover 17 is provided. The front cover 17 is rotatably supported by a front frame 200 provided between the first frame 14 and the second frame 25. The front cover 17 can be located at an opening position (see FIG. 2), at which the front cover 17 is lodged frontward to expose a first opening 13 between the first frame 14 and the second frame 15 to outside, and a closing position (see FIG. 1) at which the front cover 17 covers an upper part of a front end surface, and a front part of an upper end surface of each of the first frame 14 and the second frame 15, thereby closing the first opening 13.

Figure 5:
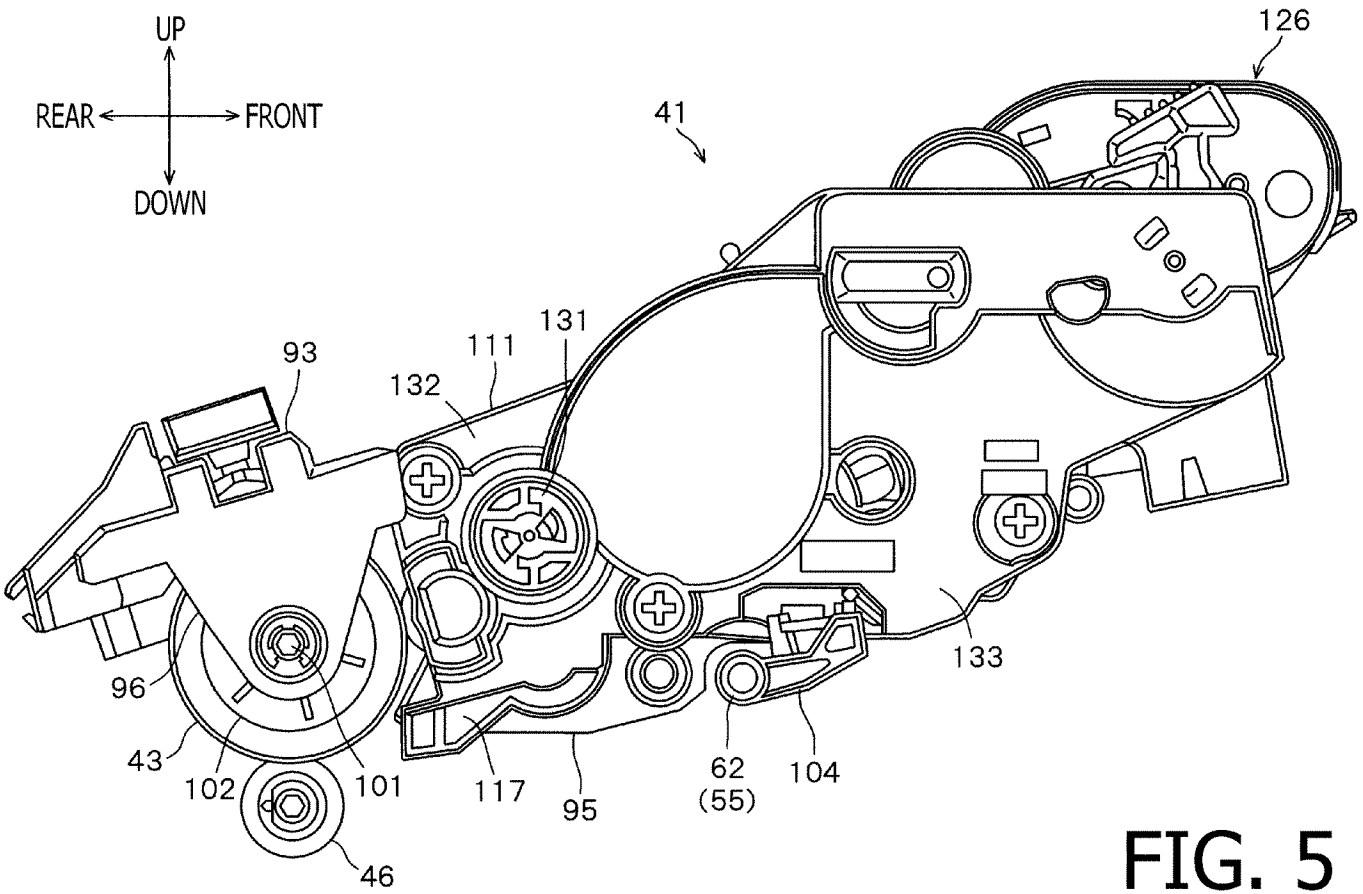
FIG. 5 is a cross-sectional left side view of the process cartridge.

As shown in FIG. 5, a second opening 18 is formed on the front cover 17. Further, a multi-purpose tray 19 is provided to the front cover 17. The multi-purpose tray 19 is configured to be displaced between an unused position at which the multi-purpose tray 19 extends in the up-down direction along a front surface of the front cover 17 located at the closing position, and a used position at which the multi-purpose tray 19 is lodged frontward from the unused position with being slightly inclined such that a front end thereof is slightly lifted. The multi-purpose tray 19 is configured to support a plurality of sheets in a stacked state when located at the used position. Further, when the multi-purpose tray 19 is located at the used position, the paper feeding port communicating inside and outside of the casing 11 is opened inside the front cover 17.

The casing 11 is provided with a top cover 21 made of resin. The top cover 21 is arranged over the first frame 14 and the second frame 15, and covers the upper end surfaces thereof. On a position at a central part in the right-left direction and on a slightly rear side of the top cover 21, a concave part 22 configured to be concaved downward is formed. The concave part 22 has a rectangular shape in its plan view, and a bottom surface 23 thereof is formed to be downwardly inclined toward the rear end thereof. The bottom surface 23, in association with a part on the front side with respect to the concave part 22 on the upper surface of the top cover 21, and the upper surface of the front cover 17 when located at the closing position, constitutes a discharge tray 24.

<Inner Configuration of Printer>

Between the first frame 14 and the second frame 15, and above the front end part of the sheet feed tray 16, a first sheet feed mechanism 31 is provided as shown in FIG. 3. The first sheet feed mechanism 31 includes the sheet feed roller 32, the separation roller and the separation pad 34. The first sheet feed mechanism 31 includes a sheet feed roller 32, a separation roller 33 and a separation pad 34.

The sheet feed roller 32 is arranged to be rotatable about an axis extending in the right-left direction. when the sheet feed tray 16 is attached to the attachment position inside the casing 11, a circumferential surface of the sheet feed roller 32 contacts a front end part of the uppermost sheet of the plurality of sheets accommodated in the sheet feed tray 16.

The separation roller 33 is arranged on a front side with respect to the sheet feed roller, and is configured to rotate about an axis extending in the right-left direction.

The separation pad 34 contacts the circumferential surface of the separation roller 33 from a lower-front side thereof when the sheet feed tray 16 is attached to the attachment position inside the casing 11.

On a deep inner side (i.e., a rear side) of the second opening 18, which is opened when the multi-purpose tray 19 is located at the used position, a second sheet feed mechanism is provided (not shown).

On a deep inner side of the first sheet feed mechanism 31, a cartridge attachment position P, which is an example of an attachment position) is defined. At the cartridge attachment position P, the process cartridge 41, which is an example of a cartridge, is to be arranged.

The process cartridge 41 has a cartridge frame 42. A photosensitive drum 43, a charger 44, a developer 45 and a transfer roller 46 are held by the cartridge frame 42. In the following description, the positions of the photosensitive drum 43, the charger 44, the developer 45 (an example of a developing part) and the transfer roller 46 when the process cartridge 41 is attached to the cartridge attachment position P will be basically referred to.

The photosensitive drum 43 is arranged on a front end part of the cartridge frame 42 so as to be rotatable about an axis extending in the right-left direction.

The charger 44 is arranged on an upper rear side with respect to the photosensitive drum 43. The charger 44 is, for example, a scorotron type charger provided with a wire and a grid.

The developer 45 is arranged on the front side with respect to the photosensitive drum 43. The transfer roller 46 is arranged below the photosensitive drum 43 so as to face the photosensitive drum 43, and is configured to rotate about an axis extending in the right-left direction.

The process cartridge 41 can be attached to the cartridge attachment position P through the first opening 13 from outside of the casing 11, and can be drawn outside the casing 11 from the cartridge attachment position P through the first opening 13, with the front cover 17 being located at the opening position.

Inside the casing 11, an exposure device 51 is arranged above the cartridge attachment position P. The exposure device 51 is provided with an optical system including a laser source and a polygonal mirror, and is configured to emit a laser beam modulated in accordance with image data. The laser beam emitted by such an exposure device 51 is incident on the circumferential surface of the photosensitive drum 43 through a space between the charger 44 and the developer 45 with the process cartridge 41 being attached at the cartridge attachment position P.

Further, inside the casing 11, a fixing device 52 is arranged on the rear side with respect to the cartridge attachment position P. the fixing device 52 has a heat roller 53 and a pressure roller 54. The heat roller 53 is configured to rotate about an axis extending in the right-left direction. The pressure roller 54 is arranged below the heat roller 53, and is also configured to rotate about an axis extending in the right-left direction. A circumferential surface of the pressure roller 54 contacts a circumferential surface of the heat roller 53.

In the casing 11, registration rollers 55, discharge rollers 56, first conveying rollers 57 and second conveying rollers 57 are further provided.

The registration rollers 55 are arranged on the front side with respect to the photosensitive drum 43 and the transfer roller 46. The photosensitive drum 43 and the registration rollers 55 are arranged to have a particular distance therebetween. The registration rollers 55 include a pair of a driving roller 61 and a driven roller 62. The driving roller 61 is configured to rotate about an axis extending in the right-left direction, and held by the casing 11. The driven roller 62 is configured to rotate about an axis extending in the right-left direction, and is held by the cartridge frame 42 of the process cartridge 41. When the process cartridge 41 is attached to the cartridge attachment position P, a circumferential surface of the driven roller 62 contacts a circumferential surface of the driving roller 61 from an upper rear side.

The casing 11 is formed with a wall surface 63 which extends upward from a rear end of the discharge tray 24 (i.e., a rear end of the bottom surface 23 of the concave part 22). On the wall surface 63, a discharge port 64 through which the sheet is discharged onto the discharge tray 24 is formed at a position spaced upward from the rear end of the discharge tray 24. The discharge rollers 56 are arranged on the rear side with respect to the discharge port 64. The discharge rollers 56 include a driving roller 65, and two driven rollers 66 and 67. Each of the driving roller 67 and the driven rollers 66 and 67 is configured to rotate about an axis extending in the right-left direction. Circumferential surfaces of the driving roller 67 and the driven rollers 66 and 67 contact each other.

The first conveying rollers 57 are arranged on an upper front side with respect to the first sheet feed mechanism 31. The first conveying rollers 57 include a pair of a driving roller 68 and a driven roller 69. Each of the driving roller 68 and the driven roller 69 is configured to rotate about an axis extending in the right-left direction. The driving roller 68 and the driven roller 69 are arranged such that circumferential surfaces thereof are contacted with each other.

The second conveying rollers 58 are arranged on an upper rear side with respect to the fixing device 52, and on a lower rear side with respect to the discharge roller 56. The second conveying rollers 58 include a pair of a driving roller 71 and a driven roller 72. Each of the driving roller 71 and the driven roller 72 is configured to rotate about an axis extending in the right-left direction. the driving roller 71 and the driven roller 72 are arranged such that circumferential surfaces thereof contact each other.

Inside the casing 11, a first conveying path 81, a second conveying path 82, a third conveying path 83 and a fourth conveying path 84 are defined.

The first conveying path 81 is formed to have a U-shape staring from a contacting part of the separation roller 33 and the separation pad 34 toward an upper rear side through the first conveying rollers 57.

The second conveying path 82 extends rearward from the first conveying path 81, passing between the registration rollers 55, passing between the photosensitive drum 43 and the transfer roller 46, to a contacting part of the heat roller 53 and the pressure roller 54 of the fixing device 52, in this order.

The third conveying path 83 extends toward an upper rear side from the second conveying path 82, passing between the first conveying rollers 57, and is curved upward toward the upper front side to form the U-shape, and reaches the discharge port 64.

The fourth conveying path 84 extends from the multi-purpose tray 19, which is located at the used position, and is converged to the second conveying path 82 from the front side.

<Operation of Printer>

When an image is printed on the sheet, the sheet is fed from the sheet feed tray 16 or the multi-purpose tray 19.

When the sheet is fed from the sheet feed tray 16, the sheet feed roller 32 of the first sheet feed mechanism 31 is rotated counterclockwise when viewed from the left side of the printer 1. As the sheet feed roller 32 is rotated, the sheet contacting the circumferential surface of the sheet feed roller 32 is fed frontward. The sheet fed from the sheet feed tray 16 passes between the separation roller 33 and the separation pad 34, thereby the sheet being fed forward one by one. That is, even if a plurality of sheets are drawn from the sheet feed tray 16, it is ensured that only one sheet proceeds forward at a time since only one sheet is extracted from the other by the separation roller 32 and the separation pad 34. The sheet passed between the separation roller 33 and the separation pad 34 enters the first conveying path 81. The sheet entered the first conveying path 81 receives the conveying force from the first conveying rollers 57 and proceeds along the first conveying path 81. Since the first conveying path 81 has the U-shaped curve, the sheet proceeds along the first conveying path 81, makes a U turn at a front end part of the casing 12, proceeds rearward and enters the second conveying path 82.

When the sheet is fed from the multi-purpose tray 19, the sheet is fed by the second sheet conveying mechanism (not shown). The sheet fed from the multi-purpose tray 19 proceeds along the conveying path 84 toward the second conveying path 82. The sheet then inters the second conveying path 82 at a converging point of the second conveying path 82 and the fourth conveying path 84.

The sheet entered the second conveying path 82 proceeds rearward along the second conveying path 82. In this instance, the registration roller 55 is stopped (i.e., not rotated). When the leading end of the sheet has reached the registration rollers 55, proceeding of the sheet is once stopped.

Incidentally, the photosensitive drum 43 rotates clockwise when viewed from the left side of the printer 1. In accordance with rotation of the photosensitive drum 43, the circumferential surface of the photosensitive drum 43 is uniformly charge by the charger 44, and then selectively exposed to the laser beam emitted by the exposure device 51. With this exposure, charges on the circumferential surface of the photosensitive drum 43 are selectively removed, thereby a electrostatic latent image being formed on the circumferential surface of the photosensitive drum 43. The electrostatic latent image is developed to a toner image as the toner is supplied from the developer 45 through a developing roller 112.

Formation of the toner image and conveyance of the sheet are executed synchronously. That is, rotation of the registration rollers 55 is started such that the sheet is located between the photosensitive drum 43 and the transfer roller 46 when the toner image faces the transfer roller 46. To the transfer roller 46, a transfer bias is applied. When the sheet passes between the photosensitive drum 43 and the transfer roller 46, due to an effect of the transfer bias, the toner image is transferred from the circumferential surface of the photosensitive drum 43 to the upper surface of the sheet.

The sheet on which the toner image has been transferred further proceeds the second conveying path 82 rearward and enters the fixing device 52. In the fixing device 52, the sheet passes between the heat roller 53 and the pressure roller 54. At this stage, by the heat and pressure applied to the sheet carrying the transferred toner image, the toner image is permanently fixed on the sheet, thereby formation of the image on the sheet being achieved. The sheet on which the image has been formed proceeds from the second conveying path 82 to the third conveying path 83.

The sheet entered the third conveying path 83 receives the conveying force of the second conveying rollers 58 and proceeds along the third conveying path 83 toward the discharge roller 56. Then, the sheet receives the conveying force, from the discharge rollers 56, to move the sheet toward the discharge tray 24, and discharged, through the discharge port 64, onto the discharge tray 24.

As above, when the image is printed on the sheet, the sheet fed from the sheet feed tray 16 is conveyed through an S-shaped conveying path including the first conveying path 81, the second conveying path 82 and the third conveying path 83, or the sheet fed from the multi-purpose tray 19 is conveyed through a conveying path including the fourth conveying path 84, the second conveying path 82 and the third sheet conveying path 83. The image is formed on the sheet when the sheet is being conveyed, and the sheet on which the image has been formed is discharged on the discharge tray 24.

<Process Cartridge>

The cartridge frame 42 of the process cartridge 41 has a right side-wall and a left side-wall (not shown) which face each other, in the right-left direction, with a certain distance therebetween. Further, the cartridge frame 42 has an upper wall 93 bridged between the right side-wall and the left side-wall, a rear bottom wall 94 and a front bottom wall 95 as shown in FIG. 3. It is noted that the rear bottom wall 94 is not shown in FIGS. 4 and 5.

On the upper wall 93, as shown in FIG. 3, the charger 44 is held. On the left end part of the upper wall 93, a drum supporting part 96 is formed as shown in FIG. 5. The drum supporting part 96 has a substantially triangular and downwardly tapered shape in a side view. On a right end part of the upper wall 93, as shown in FIG. 4, a drum supporting part 97 is formed. The drum supporting part 97 has a substantially triangular and downwardly tapered shape in a side view.

Between the drum supporting parts 96 and 97, a substantially cylindrical photosensitive drum 43 is arranged. The photosensitive drum 43 is rotatably supported by a drum shaft 101 which extends along an central axis of the photosensitive drum 43 such that the photosensitive drum 43 is rotatable with respect to the drum shaft 101. The left end part of the drum shaft 101 pierces through the drum supporting part 96 and protrudes to outside, as shown in FIG. 5, so that the left end part of the drum shaft 101 is non-rotatably supported by the drum supporting part 96. A right end part of the drum shaft 101 pierces through the drum supporting part 97 and protrudes to outside, as shown FIG. 4, so that the right end part of the drum shaft 101 is non-rotatably supported by the drum supporting part 97. At a left end part of the photosensitive drum 43, as shown in FIG. 5, a drum gear 102 is fixed.

The rear bottom wall 94 is arranged below the upper wall 93 as shown in FIG. 3. A rear end of the rear bottom wall 94 is downwardly spaced from the photosensitive drum 43, and is spaced from the transfer roller 46 rearward. The rear bottom wall 94 extends frontward from the rear end thereof along the circumferential surface of the transfer roller 46, and extends frontward such that the rear bottom wall 94 extends from a position facing a lower end of the circumferential surface of the transfer roller 46 to a position separating from the circumferential surface 46 of the transfer roller 46. The transfer roller 46 is rotatably supported by the rear bottom wall 94 and the circumferential surfaced of the transfer roller 46 contacts the circumferential surface of the photosensitive drum 43.

The front bottom wall 95 is configured such that the rear end part thereof overlaps the front end part of the rear bottom wall 94 with being spaced upwardly, and extends frontward from a position above the front end part of the rear bottom wall 94. Between the front end part of the rear bottom wall 94 and the rear end part of the front bottom wall 95, a slit 103 extending in the right-left direction is formed. The sheet passed between the registration rollers 55 enters the slit 103, and proceeds in the slit 103 toward the contacting part of the photosensitive drum 43 and the transfer roller 46. Further, the sheet passed between the photosensitive drum 43 and the transfer roller 46 further proceeds to pass through a space between the photosensitive drum 43 and the rear end of the rear bottom wall 94.

On a left end of the front bottom wall 95, a roller holding part 104 is provided at a central part, in the front-end direction, as shown in FIG. 5. On a right end of the front bottom wall 95, at a right-left symmetric position with respect to the roller holding part 104 of the left side-wall 91, a roller holding position 105 is provided as shown in FIG. 4. To the roller holding parts 105 and 104, the right and left end parts of the driven roller 62 of the registration rollers 55 are rotatably held, respectively.

Above the front bottom wall 95, as shown in FIG. 3, the developer 45 is arranged. The developer 45 has a developer casing 11, which is an example of a second cartridge, a developing roller 112, a supplying roller 113 and an agitator 114.

The developing roller 112 has a substantially cylindrical developing roller main body 115, and a developing roller shaft 116 which is inserted in the developing roller main body 115 and extends along a central axis of the developing roller main body 115. The developing roller main body 115 is arranged between a left side-wall 117 (see FIG. 5) and a right side-wall 118 (see FIG. 4) of the developer casing 11, and a part of a circumferential surface of the developing roller main body 115 is exposed outside from the developer casing 111 and contacts the circumferential surface of the photosensitive drum 43. The right end part and the left end part of the developing roller shaft 116 are inserted in the right side-wall and the left side-wall and rotatably held thereby, respectively.

The supplying roller 113 is arranged inside the developer casing 111, and a circumferential surface of the supplying roller 113 contacts the circumferential surface of the developing roller 12 from a lower front side.

The agitator 114 is arranged on the rear side with respect to the supplying roller 113, and attached to an agitator shaft 119 extending in the right-left direction. Right and left end parts of the agitator shaft 119 are inserted to the right side-wall 118 and the left side-wall 117 of the developer casing 111 and rotatably supported thereby.

On the right side-wall 118 of the developer casing 111, a developing bias terminal 121 and a supplying bias terminal 122 are provided as shown in FIG. 4.

The developing bias terminal 121 is made of electrically conductive resin and integrally provided with a contacting part 123, a connecting part 124 and a fixed part 125. The contacting part 123 is arranged on the front side with respect to the developing roller shaft 116, and has a planner surface extending in the front-rear and up-down directions. The connecting part 124 extends rearward from the contacting part 123. The developing roller shaft 116 is inserted in the connecting part 124. The fixed part 125 extends upward from the contacting part 123, and is fixed to the right side-wall 118 by means of a bolt.

The supplying bias terminal 122 is made of electrically conductive resin and arranged on an upper front side with respect to the developing bias terminal 121. The supplying bias terminal 122 is electrically connected to the supplying roller 113.

The process cartridge 41 is provided with a toner box 126 accommodating the toner (an example of a toner accommodating part). The toner box 126 is formed to have a hollow cylinder with both axial ends being closed. The toner box 126 is configured to be detachably attached to a rear end part of the developer casing 111 between the right wall 118 and the left wall 117. When the process cartridge 41 is attached to the cartridge attachment position P, the toner box 126 is arranged on the first opening 13 side with respect to the exposure device 51, and the exposure device 51 and a part of the toner box 131 overlap in the up-down direction.

On one end part, in the right-left direction, of the toner box 126, a toner outlet 127 is formed as shown in FIG. 3. On the developer casing 111, a toner inlet 128 is formed at a position facing the toner outlet 127 from below when the toner box 126 is attached to the developer casing 111. Therefore, when the toner box 126 is attached to the developer casing 111, the toner outlet 127 and the toner inlet 128 communicate with each other, thereby inside the toner box 126 and inside the developer casing 111 communicate with each other through the toner outlet 127 and the toner inlet 128.

In the toner box 126, a toner conveying member 129 (an example of a conveying member) is provided. The toner conveying member 129 is, for example, a screw auger having helical blades provided around a shaft extending in the right-left direction, and both end parts of the shaft 130 (see FIG. 6) are rotatably supported by the toner box 126. A driving force is transmitted and the toner conveying member 129 starts rotating, by the blades of the toner conveying member 129, the toner inside the toner box 126 is conveyed toward the toner outlet 127. The toner reached to the toner outlet 127 is supplied from the toner outlet 127 to the developer casing 111 through the toner inlet 128.

<Passive Mechanism>

On a left side-wall 117 of the developer casing 111, a passive coupling 131 is provided at an upper front position with respect to the developing roller shaft 116 as shown in FIG. 5. The passive coupling 131 has a hollow cylinder shape of which central axis extends in the right-left direction.

On the left side surface of the left side-wall 117, a first cover 132 and a second cover 133 are secured. The first cover 132 is arranged on a rear side with respect to the second cover 133 and adjacent thereto. The first cover 132 is formed with a circular opening 134 exposing the passive coupling 131.

Figure 6:
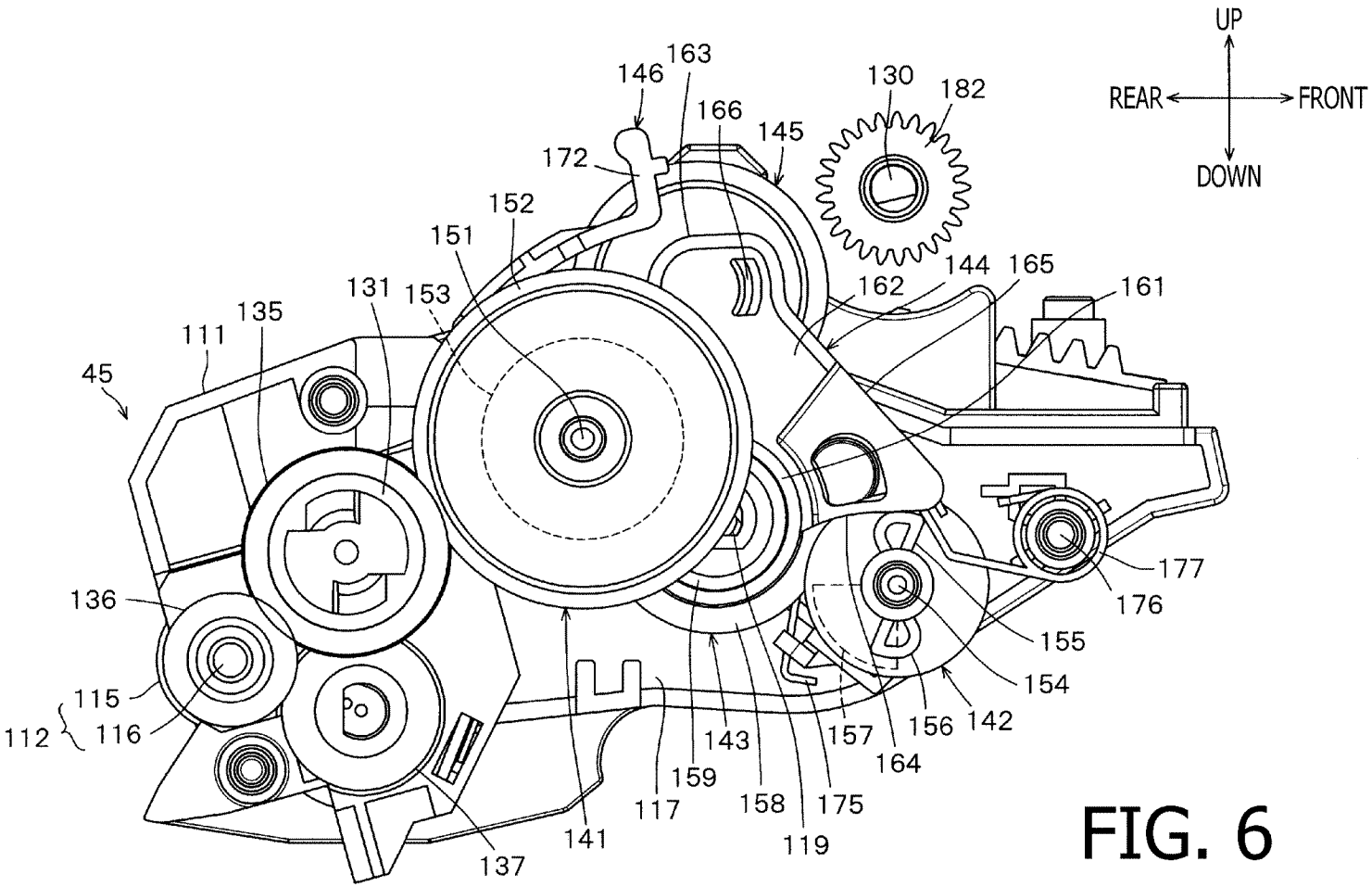
FIG. 6 is a cross-sectional left side view of a developer casing when a first cover and a second cover are removed, and a toner conveying member is in a non-driven state.
Figure 7:
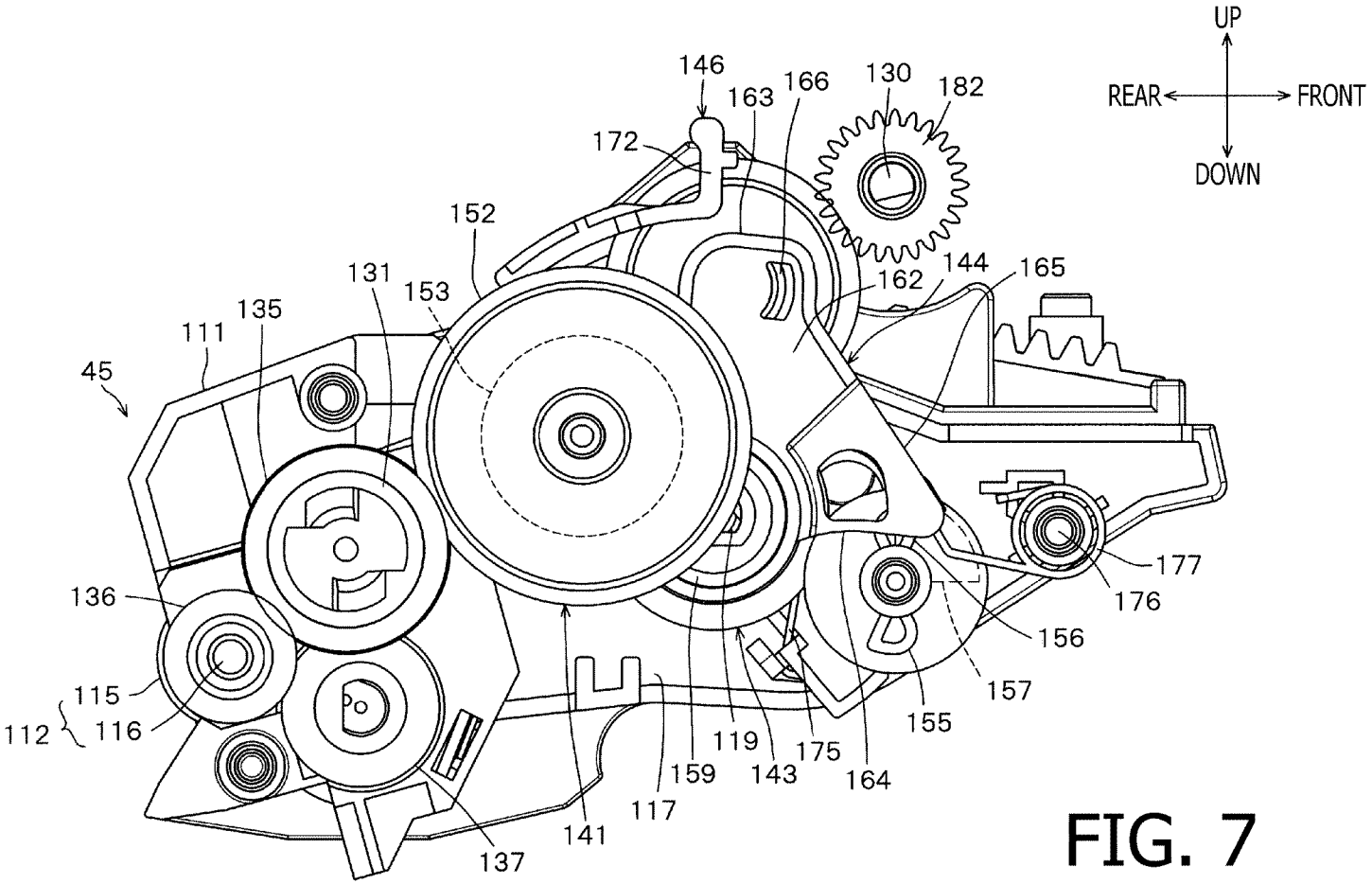
FIG. 7 is a cross-sectional left side view of the developer casing when a first cover and a second cover are removed, and a toner conveying member is in a driven state.

Inside the first cover 132, as shown in FIGS. 6 and 7, a coupling gear 135, a developing gear 136 and a supplying gear 137 are accommodated.

The coupling gear 135 is configured to rotate integrally with the passive coupling 131.

The developing gear 136 is fixedly secured to the developing roller shaft 116 such that the developing gear 136 does not rotate relative to the developing roller shaft 116. The developing gear 136 engages with the coupling gear 135.

The supplying gear 136 is configured to rotate integrally with the supplying roller 113. The supplying gear 137 engages with the coupling gear 135.

Between the left side-wall 117 and the second cover 133, a two-stage gear 141, a tooth-lacking gear 142, a transmitting gear 143, a supporting member 144, a pendulum gear 145 and a switching lever 146 are provided.

The two-stage gear 141 is rotatably supported by a shaft 151 which extends leftward from the left side-wall 117. The two-stage gear 141 includes a large-diameter gear 152 and a small-diameter gear which are arranged coaxially and integrally. The large-diameter gear 152 is configured to have a lot of gear teeth on the circumferential surface thereof, and engages with the coupling gear 135. The small-diameter gear 153 is configured to have a lot of gear teeth on a cylindrical surface having a smaller diameter than that of the large-diameter gear 135.

The left side-wall 117 has a shaft 154 extending leftward at a lower front position with respect to the shaft 151. The tooth-lacking gear 142 is rotatably supported by the shaft 154. On a left side surface of the tooth-lacking gear 142, a cam part 155 and a spring engagement part 156 are formed. The cam part 155 and the spring engagement part 156 are 180 degrees rotationally symmetry about the shaft 154 in side view. On a right side surface of the tooth-lacking gear 142, a lever engagement part 157 is formed. The lever engagement part 157 protrudes from the right side surface of the tooth-lacking gear 142, and has a fan shape of which central angle is substantially 90 degrees) in the side view. Further, the tooth-lacking gear 142 has tooth-lacking parts at which gear teeth are not provided at two circumferential areas which are rotationally symmetrical with each other.

The transmitting gear 143 is fixed to the left end part of the agitator shaft 119, and arranged between the two-stage gear 141 and the tooth-lacking gear 142. The transmitting gear 143 has a gear part 158 and a supporting part 159 in an integrated manner, of which axes are arranged on an axis of the agitator shaft 119. The gear part 158 is configured such that a lot of gear teeth are formed on a circumferential surface of the a cylindrical body, and engages with the small-diameter gear 153 of the two-stage gear 141. The gear par 158 engages with gear teeth of the tooth-lacking gear 142 when the tooth-lacking gear 158 is located at a certain position. The supporting part 159 has a cylindrical shape extending rightward from the gear part 158.

The supporting member 144 integrally has a cylindrical part 161 and a plate-like part 162. The cylindrical part 161 has a cylindrical shape of which inner diameter corresponding to an outer diameter of the supporting member 159 of the transmitting gear 143, and fitted on the supporting part 153 so as to be rotatable with respect to each other. The plate-like part 162 has a first end surface 163 extending from a first position of a circumferential surface of the cylindrical part 161, a second end surface 164 extending from a second position which is also on the circumferential surface of the cylindrical part 163 and at a position different from the first position in the rotation direction (i.e., the direction along the circumferential surface of the cylindrical part 161), and a third end surface formed over the first end surface 163 and the second end surface 164. Further, on a right side surface of the transmitting gear 143, a shaft part 166 extending rightward is formed at a corner part to which the first end surface 163 and the third end surface are connected.

The pendulum gear 145 is rotatably supported by the shaft part 166 and engages with the transmitting gear 143.

Figure 8A:
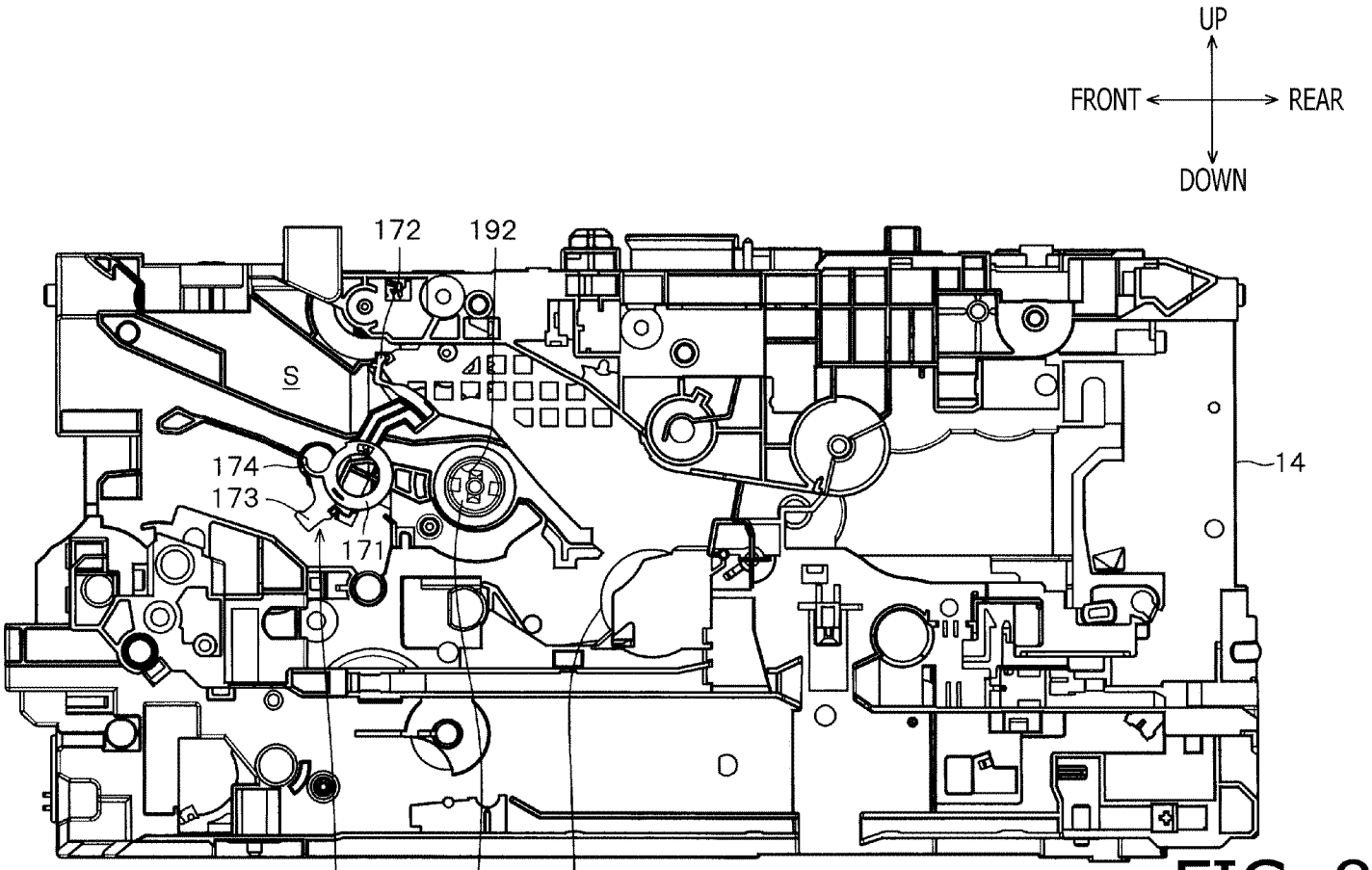
FIG. 8A is a right side view of a first frame and shows a state where a toner replenishment lever is located at a separated position.
Figure 9A:
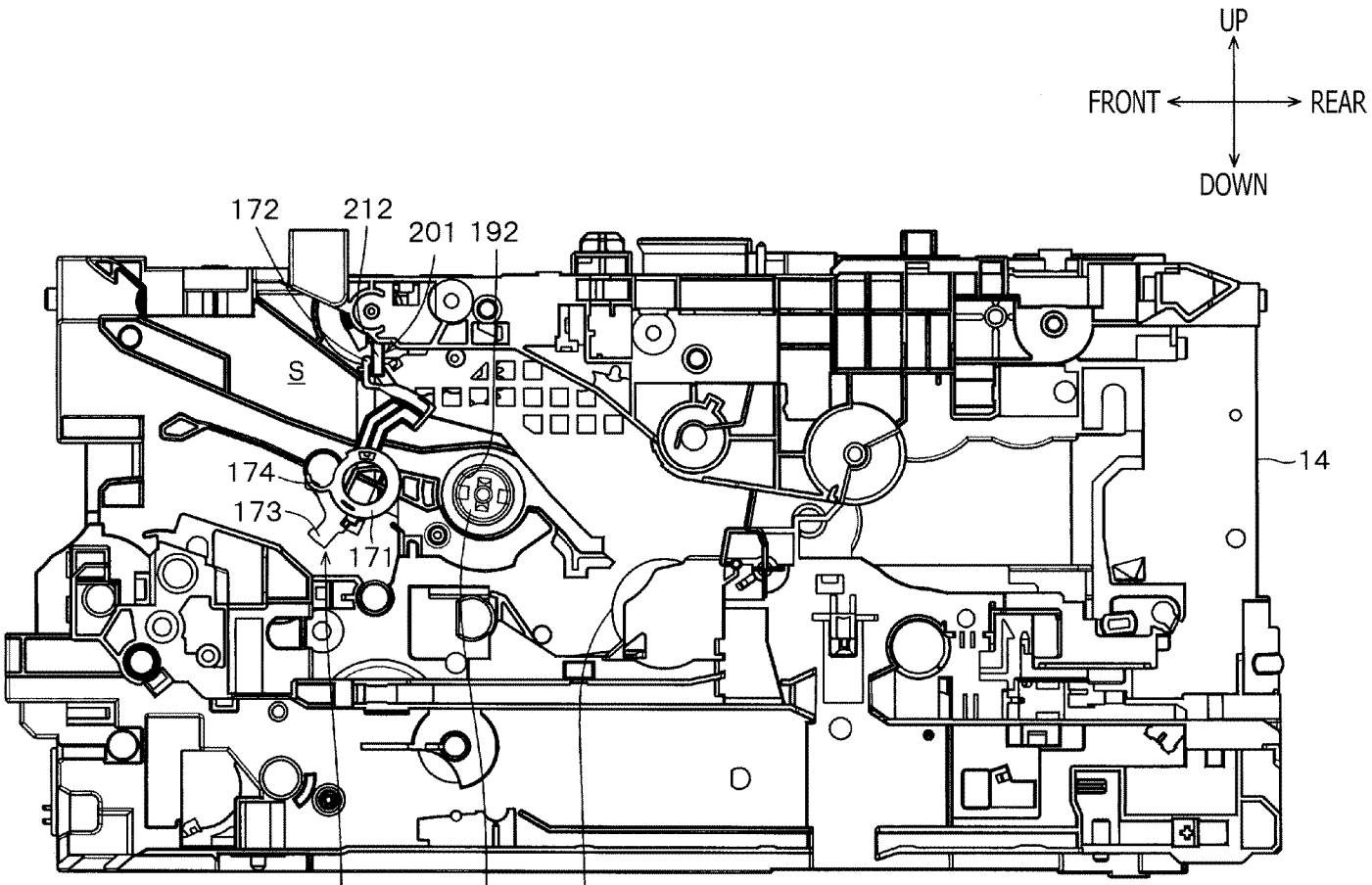
FIG. 9A is a right side view of the first frame and shows a state where the toner replenishment lever is located at a contacting position.

The switching lever 146 integrally has an outer fitting part 171, an operating part 172, a first regulating part 173 and a second regulating part 174 as shown in FIGS. 8A and 9A. The outer fitting part 171 has a cylindrical shape. On a left side-wall 117, a cylindrical shaft part (not shown) having a central axis common with that of the agitator shaft 119 is formed, and the outer fitting part 171 is rotatably fitted on the shaft part. The operation part 172 extends toward an upper rear direction from the outer fitting part 171, is bent toward an upper front side at an intermediate part and extends toward the upper front side, and is further bent and extends upward. The first regulating part 173 extends in a lower front direction from the outer fitting part 171. The second regulating part 174 extends frontward from the outer fitting part 171.

To the outer fitting part 171 of the switching lever 146, a wound part of a torsion spring 175 (see FIG. 6) which is configured by winding a metal wire is fitted. One end part of the torsion spring 175 is latched by the second regulating part 174 of the switching lever 146. The other end part of the torsion spring 175 elastically contacts the shaft 151 from below. With the elastic force the torsion spring 175 has, the switching lever 146 is urged counterclockwise in the left side view (i.e., in a direction where a tip end of the operating part 172 of the switching lever 146 moves rearward).

On the left side-wall 117, as shown in FIGS. 6 and 7, a cylindrical sprint supporting part 176 is formed to extend leftward at a position spaced frontward from the shaft 154. To the spring supporting part 176, a wound part of the torsion spring 177 which is configured by winding a metallic wire is fitted. One end of the torsion spring 177 is latched by the left side-wall 117, while the other end of the torsion spring 177 extends toward the tooth-lacking gear 142.

As shown in FIG. 6, when the cam part 155 of the tooth-lacking gear 142 contacts the second end surface 164 of the supporting member 144 from below, the other end part of the torsion spring 177 elastically contacts the cam part 155 of the tooth-lacking gear 142 from the upper front side. In this state, one of tooth-lacking parts of the tooth-lacking gear 142 faces the transmitting gear 143, and the tooth-lacking gear 142 and the transmitting gear 143 do not engage with each other. Further, the lever engagement part 157 of the tooth-lacking gear 142 contacts a tip end wall 181 (see FIG. 15A) of the first regulating part 173 of the switching lever 146 from the upper rear side, and a rotating movement of the tooth-lacking gear 142 by the urging force of the torsion spring 177 is restricted. The supporting member 144 is located at the non-driving position, and the pendulum gear 145 is spaced rearward from a conveying gear 182 which is fixedly secured to the left end part of the shaft 130 of the toner conveying member 129.

Therefore, when the passive coupling 131 is rotated and the rotational force thereof is transmitted, through the coupling gear 135 and the two-stage gear 151, to the transmitting gear 143, the pendulum gear 145 idles, thereby the rotational force not being transmitted from the pendulum gear 145 to the conveying gear 182. Thus, the non-driven state in which the conveying gear 182 does not rotate and the toner conveying member 129 does not rotate is maintained. Incidentally, the agitator shaft 119 (agitator 114) rotates integrally with the transmitting gear 143. Further, the rotational force of the passive coupling 131 is transmitted, through the coupling gear 135, to the developing gear 136 and the supplying gear 137, thereby the developing roller 112 and the supplying roller 113 rotating.

Assuming that a current state of the developer 111 is as shown in FIG. 6, and if the tip end part of the operating part 172 of the switching lever 146 is pushed frontward, and the switching lever 146 is rotated clockwise, in the left side view, to a pushed position as shown in FIG. 7, the engagement of the lever engagement part 157 of the tooth-lacking gear 142 with the first regulating part 173 of the switching lever 145 is disengaged during rotation of the switching lever 146, and the tooth-lacking gear 142 becomes rotatable. Then, due to the urging force of the torsion spring 177, the tooth-lacking gear 142 rotates counterclockwise in the left side view. As a result of this rotation, the tooth-lacking gear 142 engages with the transmitting gear 143. As the tooth-lacking gear 142 engages with the transmitting gear 143, by the rotational force (i.e., the driving force) transmitted from the transmitting gear 143 to the tooth-lacking gear 142, the tooth-lacking gear 142 further rotates counterclockwise in the left side view. In accordance with the rotation of the tooth-lacking gear 142, the cam part 155 of the tooth-lacking gear 142 moves away from the second end surface 164 of the supporting member 144, the supporting member 144 rotates clockwise in the left side view. As the supporting member 144 rotates, as shown in FIG. 7, the pendulum gear 145 approaches the conveying gear 182 and engages therewith.

As the tooth-lacking gear 142 rotate further, the spring engagement part 156 of the tooth-lacking gear 142 contacts the other end part of the torsion spring 177. Then, in association with rotation of the tooth-lacking gear 142, the spring engagement part 156 pushes up the torsion spring 177. Then, elastic energy of the torsion spring 177 increases. Further, the other of the tooth-lacking parts of the tooth-lacking gear 142 faces the transmitting gear 143, and the engagement of the tooth-lacking gear 142 with the transmitting gear 143 is released. Furthermore, the lever engagement part 157 of the tooth-lacking gear 142 contacts the second regulating part 174 of the switching lever 146 from the front side, and the rotation of the tooth-lacking gear 142 due to the urging force of the torsion sprint 177 is restricted. According to the above configuration, the supporting member 144 is maintained to be located at the driving position at which the pendulum gear 145 engages with the conveying gear 182.

Then, the passive coupling 131 is rotated, the rotating force of the passive coupling 131 is transmitted from the coupling gear 135, through the two-stage gear 141, to the transmitting gear 143, then transmitted to the transmitting gear 143, through the pendulum gear 145, to the conveying gear 182. Since the conveying gear 182 rotates, the toner conveying member 129 is in a driven state and is rotated.

When pressure of the operating part 172 of the switching lever 146 is released, the switching lever 146 is rotated counterclockwise in left side view to a non-pressing position as shown in FIG. 6. During this rotation, the engagement between the lever engagement part 157 of the tooth-lacking gear 142 and second regulating part 174 of the switching lever 146 is released, and the tooth-lacking gear 142 becomes rotatable. Thus, by the urging force of the torsion spring 177, the tooth-lacking gear 142 rotates counterclockwise in left side view. By this rotation, the tooth-lacking gear 142 engages with the transmitting gear 143. When the tooth-lacking gear 142 engages with the transmitting gear 143, by the rotating force (i.e., driving force) transmitted from the transmitting gear 143 to the tooth-lacking gear 142, the tooth-lacking gear 142 further rotates counterclockwise in left side view. By the rotation of the tooth-lacking gear 142, the cam part 155 of the tooth-lacking gear 142 contacts the second end surface 164 of the supporting member 144. Thereafter, in association with rotation of the tooth-lacking gear 142, the cam part 155 pushes up the second end surface 164, and the supporting member 144 rotates counterclockwise in left side view. By rotation of the supporting member 144, the pendulum gear 145 is spaced from the conveying gear 182, and the engagement between the pendulum gear 145 and the conveying gear 182 is released.

Further, the cam part 155 of the tooth-lacking gear 142 contacts the other end part of the torsion spring 177. Then, in association with the rotation of the tooth-lacking gear 142, the spring engagement part 156 lifts up the torsion spring 177, thereby the elastic energy of the torsion spring 177 being increased. Further, the lever engagement part 157 of the tooth-lacking gear 142 engages with the first regulating part 173 of the switching lever 146, the rotation of the tooth-lacking gear 142 by the urging force of the torsion spring 177 is restricted. Then, the supporting member 144 is maintained at the non-driving position, and the non-driving state, in which the toner conveying member 129 does not rotate, is maintained.

<Driving Mechanism for Developing>

To the first frame 14, as shown in FIGS. 8A and 9A, a driving gear 191 is provided. The driving gear 191 engages with the drum gear 102 of the process cartridge 41 in a state where the process cartridge 41 is attached to the cartridge attachment position P. The driving gear 191 is rotatably supported by the first frame 14 so as to rotate about a rotational axis extending in the right-left direction. To the driving gear 191, a driving force of a motor (not shown) arranged on the left side with respect to the first frame 14 is transmitted.

On the first frame 14, a coupling arrangement part 192 is formed as a circular opening piercing in the right-left direction at a position facing the passive coupling 131 in a state where the process cartridge 41 is attached to the cartridge attachment position P. At the coupling arrangement part 192, a driving coupling 193 is provided. To the driving coupling 193, a driving force of a motor (not shown) arranged on the left side with respect to the first frame 14 is transmitted.

To the driving coupling 193, an interlocking mechanism is connected. The interlocking mechanism causes the driving coupling 193 to move between an advanced position at which the driving coupling 193 is advanced rightward from the coupling arrangement part 192, and a retracted position at which the driving coupling 193 is retracted inside the coupling arrangement part 192. In a state where the front cover 17 is located at the opening position, the driving coupling 193 is located at the retracted position. When the front cover 17 is moved from the opening position to the closing position, the driving coupling 193 advances from the retracted position to the advanced position. In a state where the driving coupling 193 is located at the advanced position, the driving coupling 193 is engaged with the passive coupling 131 of the process cartridge 41. As the driving coupling 103 and the passive coupling 131 are engaged with each other, the driving force of the motor is input from the driving coupling 103 to the passive coupling 131, and by the driving force, the passive coupling 131 is rotated.

Figure 8B:
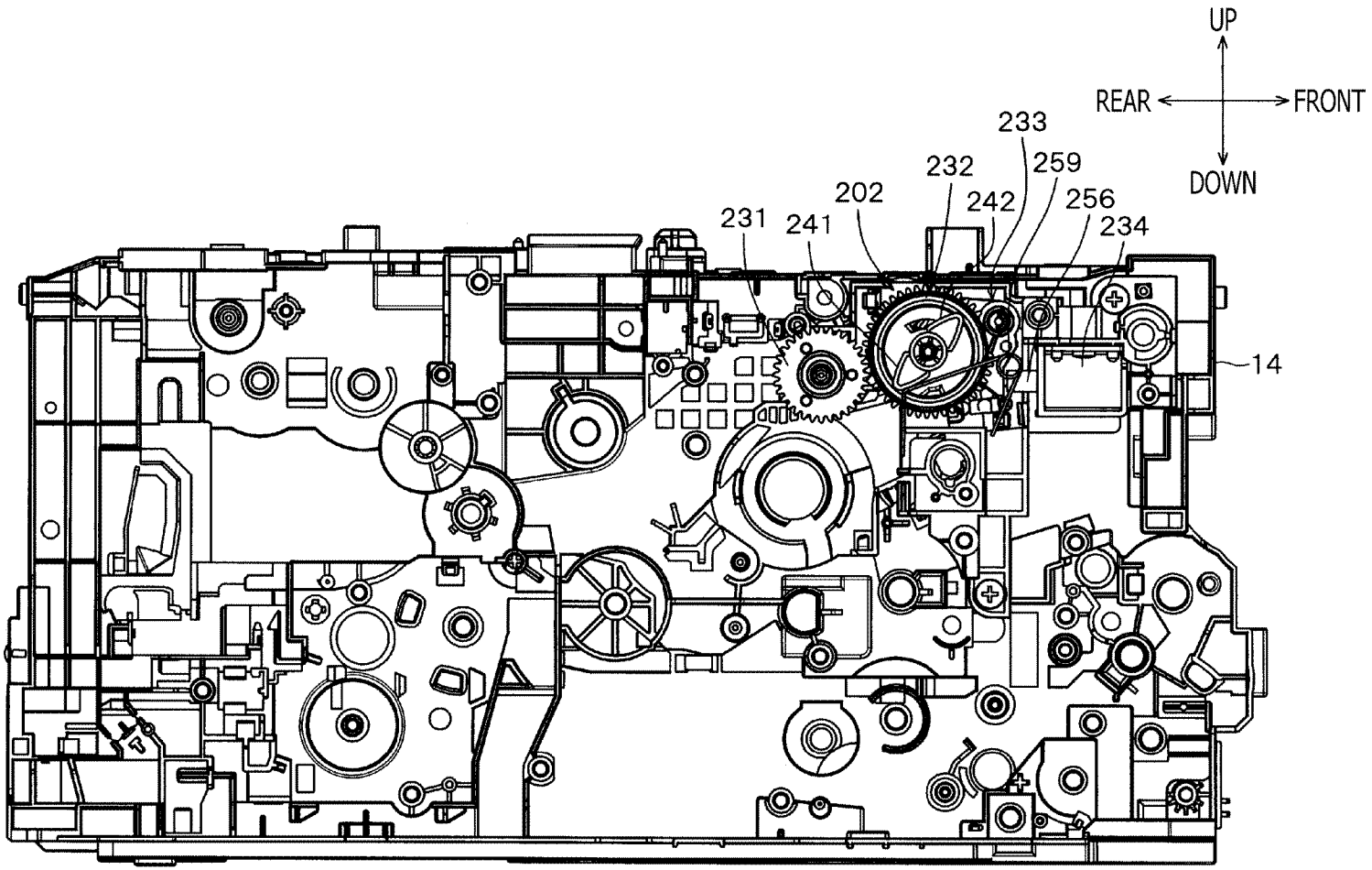
FIG. 8B is a left side view of the first frame and shows a state where the toner replenishment lever is located at the separated position.
Figure 9B:
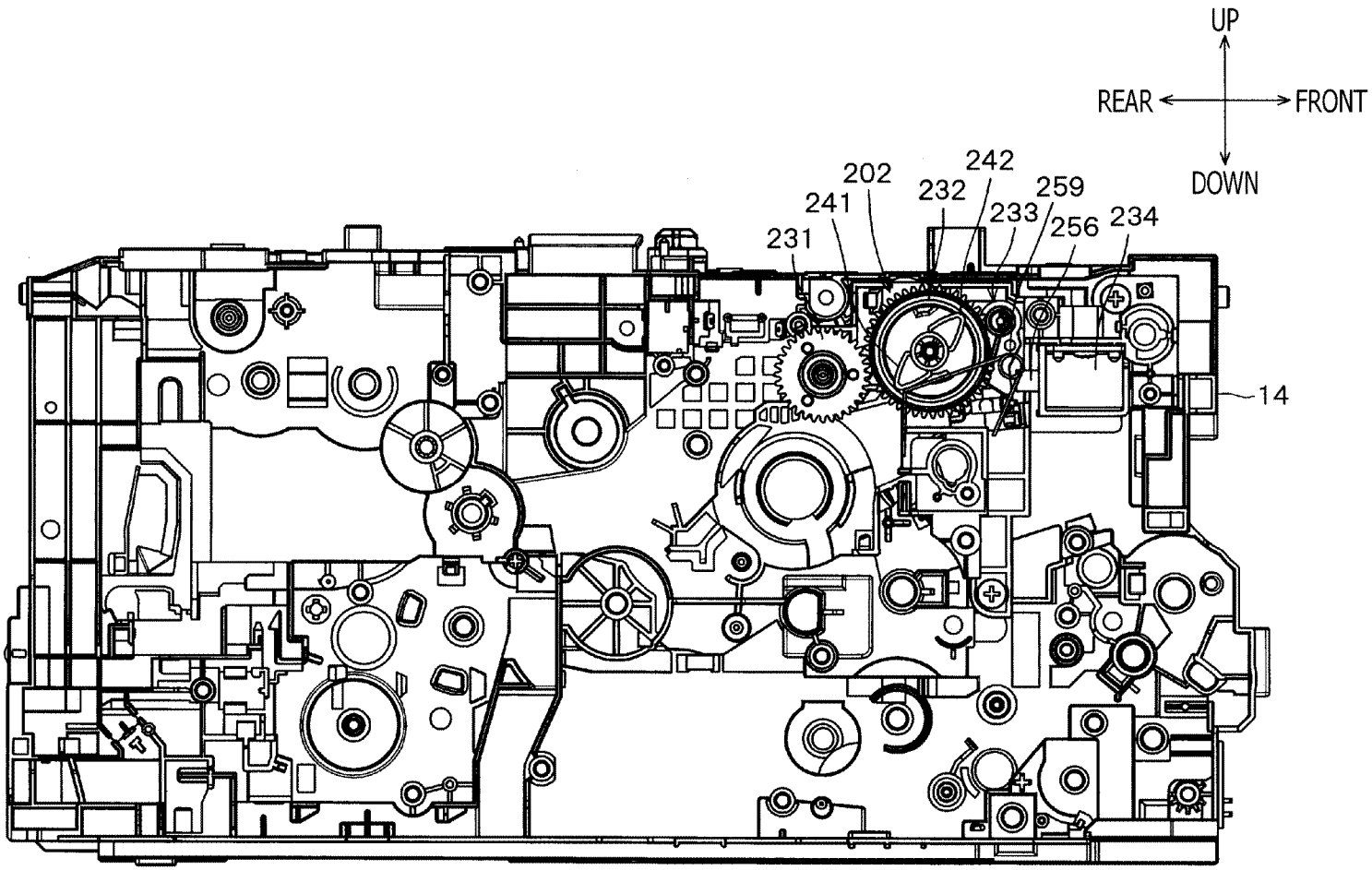
FIG. 9B is a left side view of the first frame and shows a state where the toner replenishment lever is located at the contacting position.

On an upper front portion the first frame 14, concretely, on a front side with respect to the exposure device 51 shown in FIG. 3, a toner replenishment lever 201 (see FIG. 9A) and a lever driving mechanism 202 (see FIGS. 8B and 9B) are provided.

Figure 10:
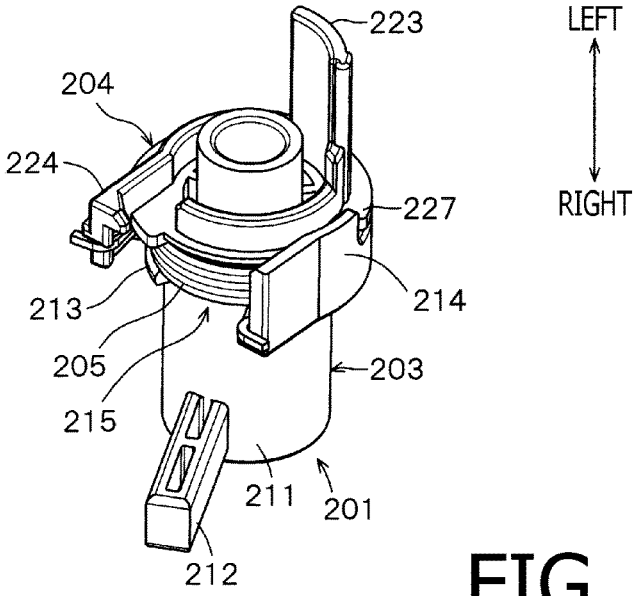
FIG. 10 is a perspective view of the toner replenishment lever.
Figure 11:
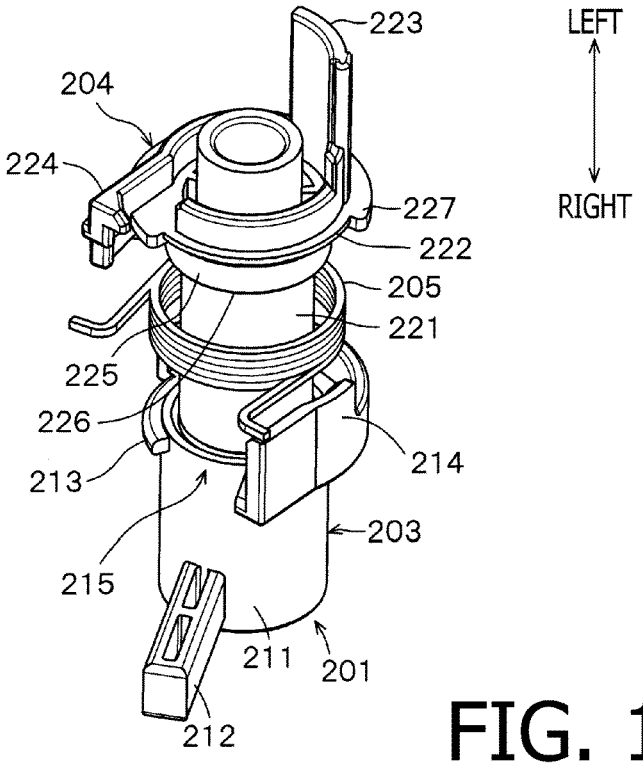
FIG. 11 is an exploded perspective view of the toner replenishment lever.

The toner replenishment lever 201 has a first revolving member 203, a second revolving member 204 and a torsion spring 205 as shown FIGS. 10 and 11.

The first revolving member 203 is arranged on the right side with respect to the first frame 14. The first revolving member 203 integrally includes an outer cylinder 211, a contacting part 212, a flange 213 and a first engaging wall 214. The outer cylinder 211 has a cylindrical shape of which central axis extends in the right-left direction. The contacting part 212 linearly extends from a circumferential surface at a right end part of the outer cylinder 211. The flange 213 radially protruding outward from the circumferential surface at a left end part of the outer cylinder 211 and extending along a left end edge of the outer cylinder 211. A partial area 215 of the outer circumferential surface of the outer cylinder 211, the flange 213 is not formed. Further, the first engaging wall 214 is formed as a wall extending leftward from one end part of the flange 213.

The second revolving member 204 integrally includes an inner cylinder 221, a flange 222, a revolving operation member 223 and a second engaging wall 224. The inner cylinder 221 has an outer diameter corresponding to the inner diameter of the outer cylinder 211 of the first revolving member 203 except for the left end part thereof. The inner cylinder 221 is inserted in the outer cylinder 211 from the left side of the outer cylinder 211 such that the inner cylinder 221 is rotatable relative to the outer cylinder 211. The outer diameter of a left end part 225 of the inner cylinder 221 is larger than the inner diameter of the outer cylinder 211. With this configuration, a step is formed on the outer circumferential surface of the inner cylinder 221, and an annular surface 226 formed by the step contacts the left end surface of the outer cylinder 211.

The flange 222 radially extends outward from the circumferential surface of the left end part 225*a* of the inner cylinder 221, and extends along the left end edge of the left end part 225 over the entire circumference thereof. At a particular part of the flange 222, a revolving stopper 227 is formed to radially protrude. The revolving operation member 223 is a plate extending leftward from the flange 222, and having a shape of an arc centering about a rotation axis of the second revolving member 204. The revolving operation member 223 extends over the right side and the left side of the first frame 14, a tip end of the revolving operation member 223 is located on the left side with respect to the first frame 14. The second engaging wall 224 is formed to be a wall extending leftward from the flange 222, the faces the first engaging wall 214 of the first revolving member 203.

The torsion spring 205 is configured by winding a metal wire, and a wound part thereof is fitted on the left end part 225 of the inner cylinder 221 of the second revolving member 204. Then, the torsion spring 205 is elastically deformed such that the one end and the other end of the torsion spring 205 approach to each other, and the one end is engaged with the first engaging wall 214 of the first revolving member 203, and the other end is engaged with the second engaging wall 244 of the second revolving member 204. With this configuration, the first revolving member 203 and the second revolving member 204 are urged to rotate in opposite directions, and the first engaging wall 214 of the first revolving member 203 and the revolving stopper 227 of the second revolving member 204 are connected in a contacted state. When the second revolving member 204 is in a stopped state, the first revolving member 203 is rotatable between a rotated position at which the first engaging wall 214 contacts the revolving stopper 227 and another rotated position at which the first engaging wall 214 contacts the second engaging wall 224 of the second revolving member 204.

Figure 12:
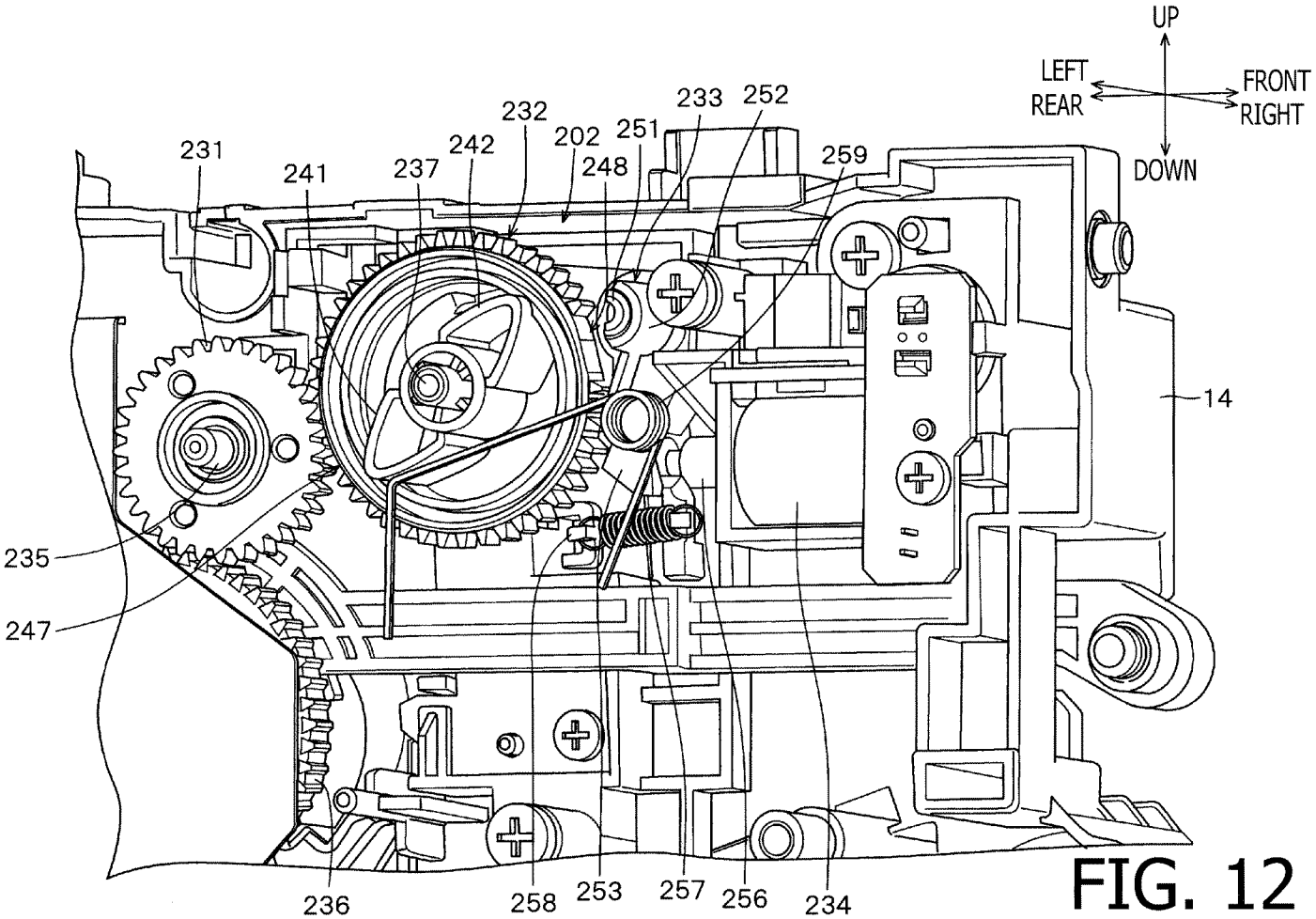
FIG. 12 is a perspective view of an upper front part of the first frame when viewed from a left front side.
Figure 13:
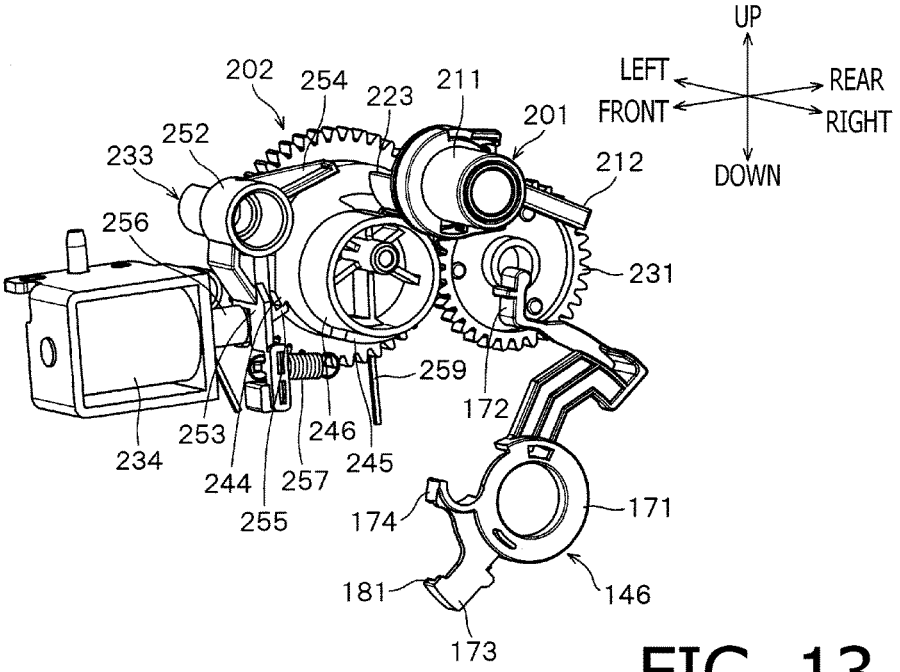
FIG. 13 is a perspective view of a switching lever, the toner replenishment lever, and a lever driving mechanism.

The lever driving mechanism 202 is arranged on the left side of the first frame 14 as shown in FIG. 12. The lever driving mechanism 202 includes, as shown in FIGS. 12 and 13, an intermediate gear 231, a tooth-lacking gear 232, a revolving regulation member 233 and a solenoid 234.

The intermediate gear 231 is rotatably supported by a shaft 235 which extends leftward from the first frame 14 as shown in FIG. 12. To the driving coupling 193 (see FIG. 8A), an input gear 236, to which the driving force of the motor is input, is connected so that the input gear 236 and the driving coupling 193 rotate integrally.

Figure 14:
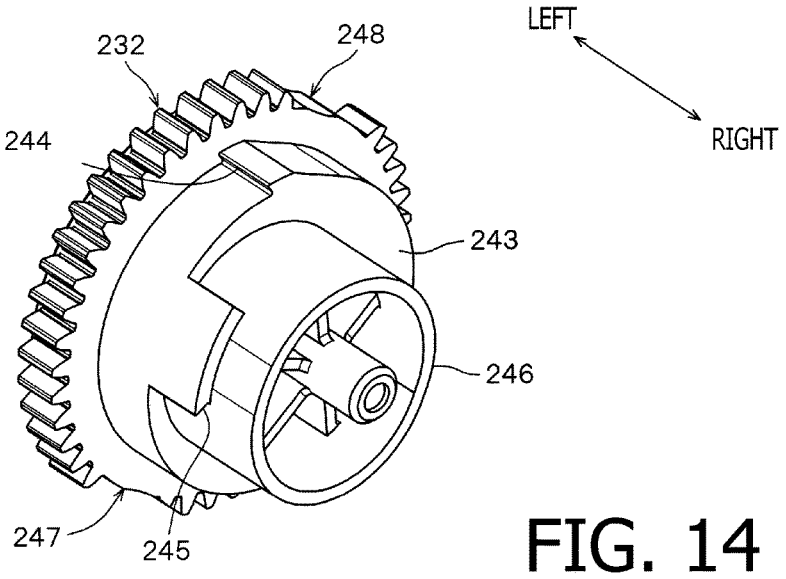
FIG. 14 is a perspective view of a tooth-lacking gear of the lever driving mechanism.

To the first frame 14, a shaft 237 extending leftward is provided at a position spaced, on the upper front side, from the shaft 235. The tooth-lacking gear 232 is rotatably supported by the shaft 237. On the left side surface of the tooth-lacking gear 232, two spring engagement parts 241 and 242 are formed at positions which are 180 degrees rotationally symmetry positions. On the right side surface of the tooth-lacking gear 232, as shown in FIG. 14, a cylindrical part 243, a first contacting part 244, a second contacting part 245 and an eccentric cam 246 are formed. The cylindrical part 243 has a flat cylindrical shape of which central axis coincides with a rotational axis of the tooth-lacking gear 232. The first contacting part 244 is configured to expand radially from the circumferential surface of the cylindrical part 243, and forms substantially a triangular shape in the right side view. The second contacting part 245 is provided to a rotational position which is different from the rotational position of the first contacting part 244. The second contacting part 245 extends rightward and is formed to be a curved (i.e., an arc-shaped) plate which is curved along the curvature of the circumferential surface of the cylindrical part 243. The eccentric cam 246 has a cylindrical shape of which central axis is shifted from the central axis of the shaft 237, and is configured to protrude rightward from the right end surface of the cylindrical part 243. A portion of the circumferential surface of the eccentric cam 246 farthest from the shaft 237 races the center, in the rotation direction, of the second contacting part 245 from a radially inner side. The tooth-lacking gear 232 has two tooth-lacking parts 247 and 248 at two rotationally symmetrical portions on the circumferential surface. Each of the tooth-lacking parts 247 and 248 is configured such that gear teeth are lacking. The tooth-lacking gear 232 engages with the intermediate gear 231 depending on the rotational position thereof.

To the first frame 14, as shown in FIG. 12, a shaft 251 extending leftward is provided at a position spaced from the shaft 237 on the upper front side as shown in FIG. 12. The revolving regulation member 233 integrally has an outer fitting part 252, first regulating part 253 and a second regulating part 254. The outer fitting part 252 has a cylindrical shape and rotationally fitted on the shaft 251. The first regulating part 253 extends downward from the outer fitting part 252. At a tip end of the first regulating part 253, as shown in FIG. 13, a protrusion 255 protruding rearward from the rear end surface of the first regulating part 253 is formed. The second regulating part 254 is arranged on the right side with respect to the first regulating part 254, and extends rearward from the outer fitting part 252.

The solenoid 234 is attached to the left side surface of the first frame such that a plunger 256 is configured to advance rearward and retract frontward. A tip end of the plunger 256 is connected to the first regulating part 253 of the revolving regulation member 233.

To the first regulating part 253, an end of a coil spring 257 is connected. The coil spring 207 extends rearward from the end, and the other end is hooked to a hook 258 provided to the first frame 14 as shown in FIG. 12. Due to elasticity the coil sprint 257 has, the first regulating part 253 is urged in the advancing direction of the plunger 256 of the solenoid 234.

On the left side of the first frame 14, a torsion spring 259 is provided. One end of the torsion spring 259 is fixed to the first fame 14. The other end of the torsion spring 259 extends from the front side of the tooth-lacking gear 232 toward a position below the spring engagement parts 241 and 242 of the tooth-lacking gear 232.

Figure 15A:
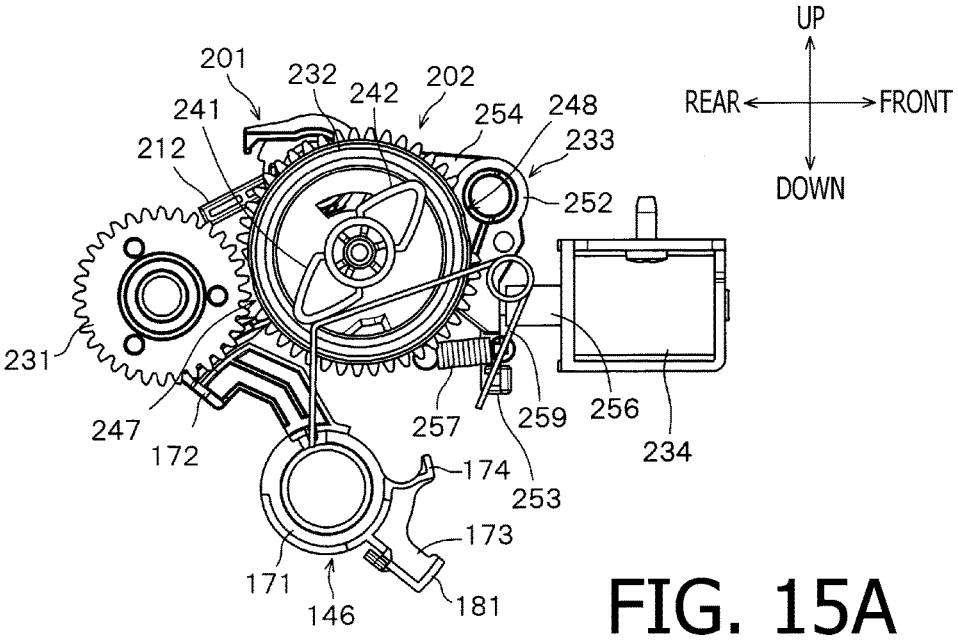
FIG. 15A is a left side view of the switching lever, the toner replenishment lever and the lever driving mechanism, and shows a state where a solenoid is not energized.
Figure 15B:
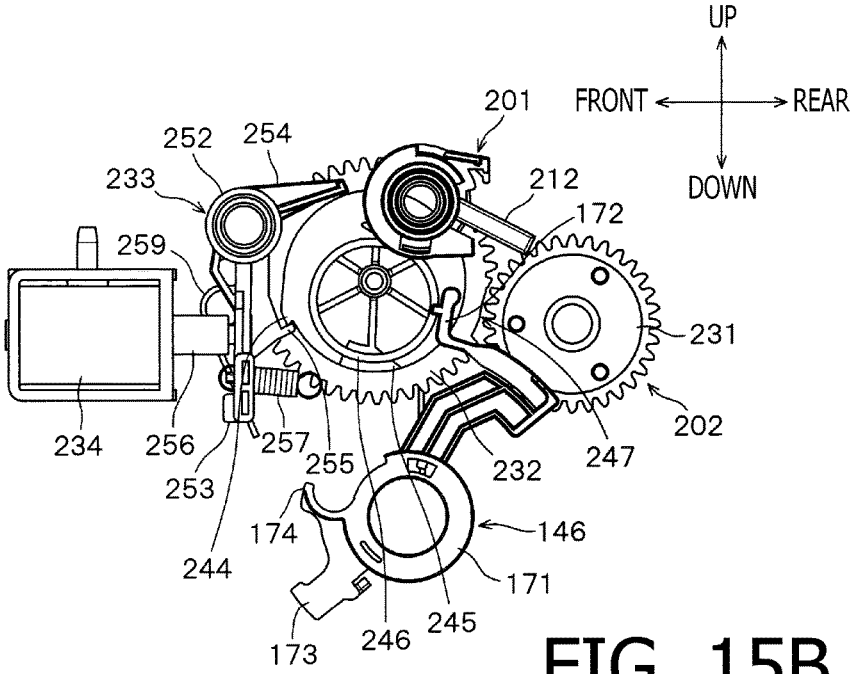
FIG. 15B is a right side view of the switching lever, the toner replenishment lever and the lever driving mechanism, and shows a state where the solenoid is not energized.

As shown in FIGS. 15A and 15B, when the tonner replenishment lever 201 is located at a spaced position (which is an example of a second position), the contacting part 212 of the toner replenishment lever 201 extends toward a lower rear side from the outer cylinder 211, and the contacting part 212 is retracted in an upper part of a space S through which the process cartridge 41 passes when attached/detached as shown in FIG. 8A. In this state, the solenoid 234 is not energized, and the plunger 256 is located at the advanced position. Further, as shown in FIG. 15A, the other end of the torsion spring 259 contacts the spring engagement part 241 of the tooth-lacking gear 232 from below. Furthermore, as shown in FIG. 15B, the protrusion 255 of the first regulating part 253 of the revolving regulation member 233 contacts the first contacting part 244 of the tooth-lacking gear 232 from below, thereby the rotation of the tooth-lacking gear 232 by the urging force of the torsion spring 259 being regulated. Still further, as shown in FIGS. 13 and 15B, a circumferential surface of the revolving operation member 223 of the toner replenishment lever 201 contacts a position in the vicinity of the position, on the circumferential surface of the eccentric cam 246 of the tooth-lacking gear 232, closest from the shaft 237. Further, the tooth-lacking part 247 of the tooth-lacking gear 232 faces the intermediate gear 231, and thee intermediate gear 231 and the tooth-lacking gear 232 are not engaged with each other.

Figure 16A:
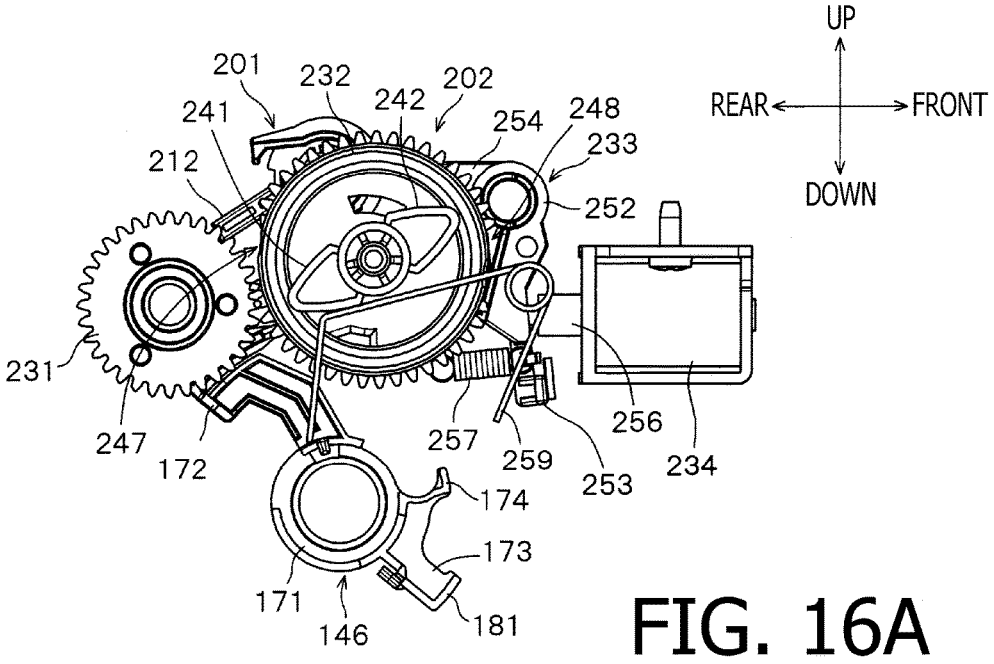
FIG. 16A is a left side view of the switching lever, the toner replenishment lever and the lever driving mechanism, and shows a state immediately after the solenoid was energized.
Figure 16B:
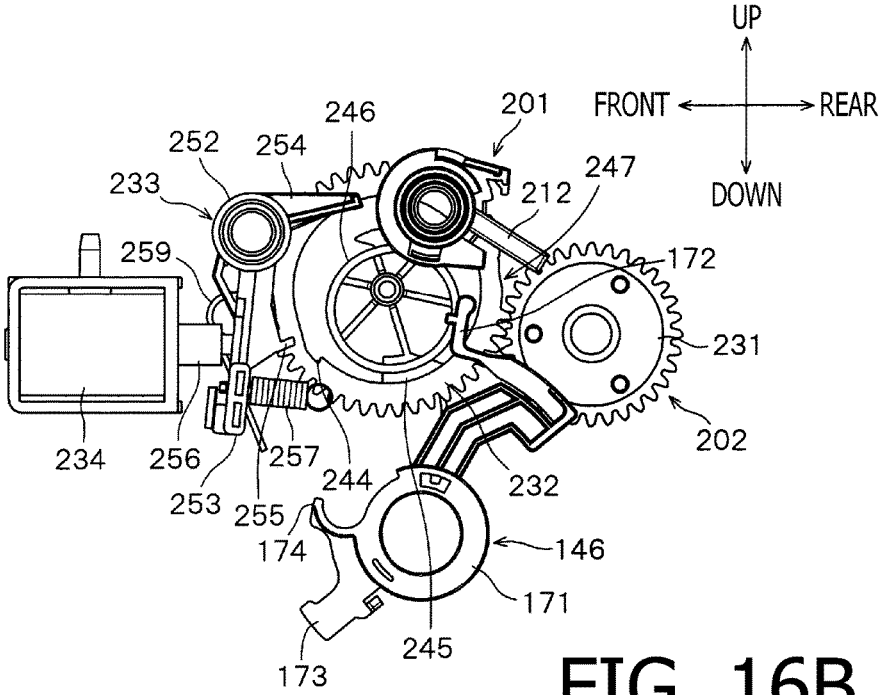
FIG. 16B is a right side view of the switching lever, the toner replenishment lever and the lever driving mechanism, and shows a state immediately after the solenoid was energized.

When the solenoid 234 is energized in the above state, and the plunger 256 is drawn from the advanced position to the retracted position as shown in FIGS. 16A and 16B, the revolving regulation member 232 rotates clockwise in the right side view, engagement between the protrusion 255 of the first regulating part 253 and the first contacting part 244 of the tooth-lacking gear 232 is released as shown in FIG. 16B, and the tooth-lacking gear 232 becomes rotatable. Thus, by the urging force of the torsion spring 259, the tooth-lacking gear 232 rotates clockwise in the left side view as shown in FIG. 16A. With this rotation, the tooth-lacking gear 232 engages with the intermediate gear 231.

Figure 17A:
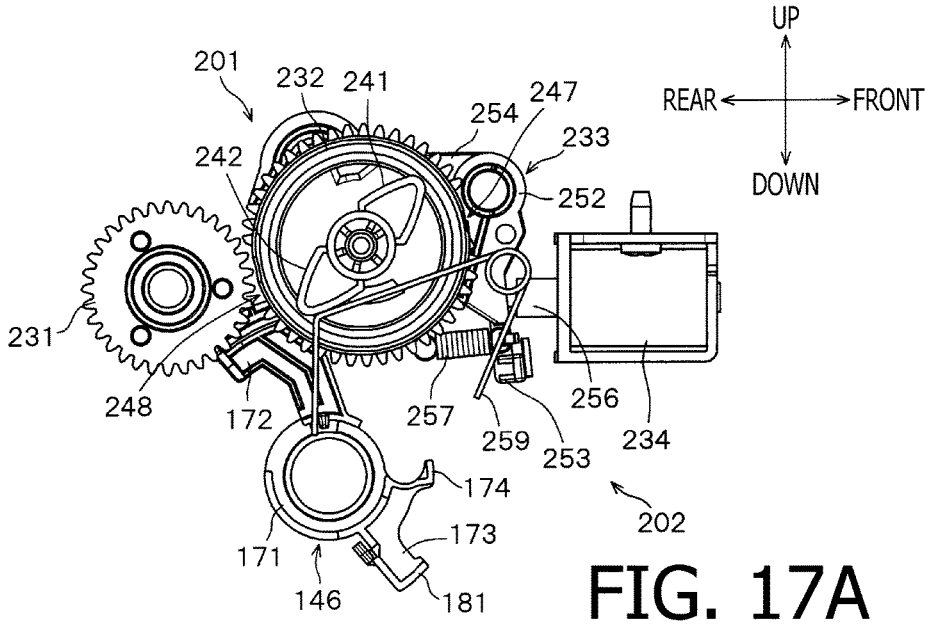
FIG. 17A is a left side view of the switching lever, the toner replenishment lever and the lever driving mechanism, and shows a driving state of the toner conveying member.
Figure 17B:
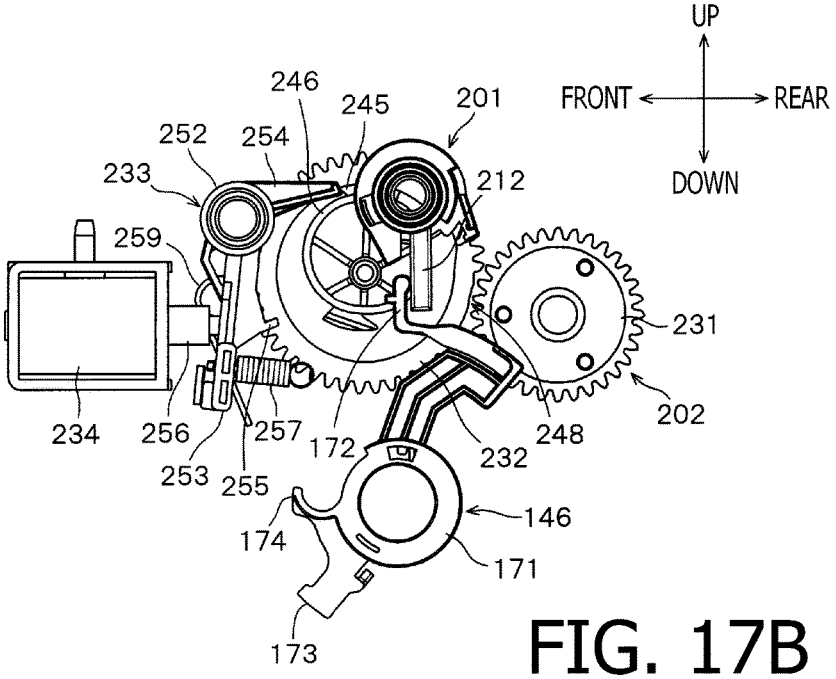
FIG. 17B is a right side view of the switching lever, the toner replenishment lever and the lever driving mechanism, and shows a driving state of the toner conveying member.

When the intermediate gear 231 and the tooth-lacking gear 232 engage with each other, the driving force transmitted from the input gear 236 (see FIG. 12) to the intermediate gear 231 is further transmitted from the intermediate gear 231 to the tooth-lacking gear 232, and the tooth-lacking gear 232 further rotates clockwise in the left side view as shown in FIG. 17A. In association with the rotation of the tooth-lacking gear 232, as shown in FIG. 17B, the eccentric cam 246 of the tooth-lacking gear 232 rotates counterclockwise in the right side view, and the revolving operation member 223 of the toner replenishment lever 210 receives a driving force to rotate the revolving operation member 223 clockwise in the right side view from the eccentric cam 264. By this rotational force, the toner replenishment lever 201 rotates clockwise in the right side view from the spaced position. During the rotation of the toner replenishment lever 201 from a contact position at which the contacting part 212 of the toner replenishment lever 201 extends downward from the outer cylinder 211 (which is an example of a first position), the contacting part 2121 contacts the operating part 172 of the switching lever 136 from the rear side, thereby the operating part 172 being pushed frontward by the contacting part 212. By this pushing force, the switching lever 146 rotates and, as described above, the toner conveying member 129 is in the driven state in which the toner conveying member 120 is rotated.

In a state where the toner replenishment lever 201 is located at the contact position, as shown in FIG. 17A, the other end of the torsion spring 259 contacts the engagement part 242 of the tooth-lacking gear 232 from below. Further, the tooth-lacking part 248 of the tooth-lacking gear 232 faces the intermediate gear 231, thereby the engagement between the intermediate gear 231 and the tooth-lacking gear 232 being released. Further, as shown in FIG. 17B, the second contacting part 245 of the tooth-lacking gear 232 contacts the second regulating part 254 of the revolving regulation member 233 from the rear side, thereby rotation of the tooth-lacking gear 232 by the urging force of the torsion spring 259 being regulated. With the above configuration, a state where the contacting part 212 of the toner replenishment lever 201 presses the operating part 172 of the switching lever 146 is maintained, thereby the switching lever 146 being maintained at the pushed position.

Figure 18A:
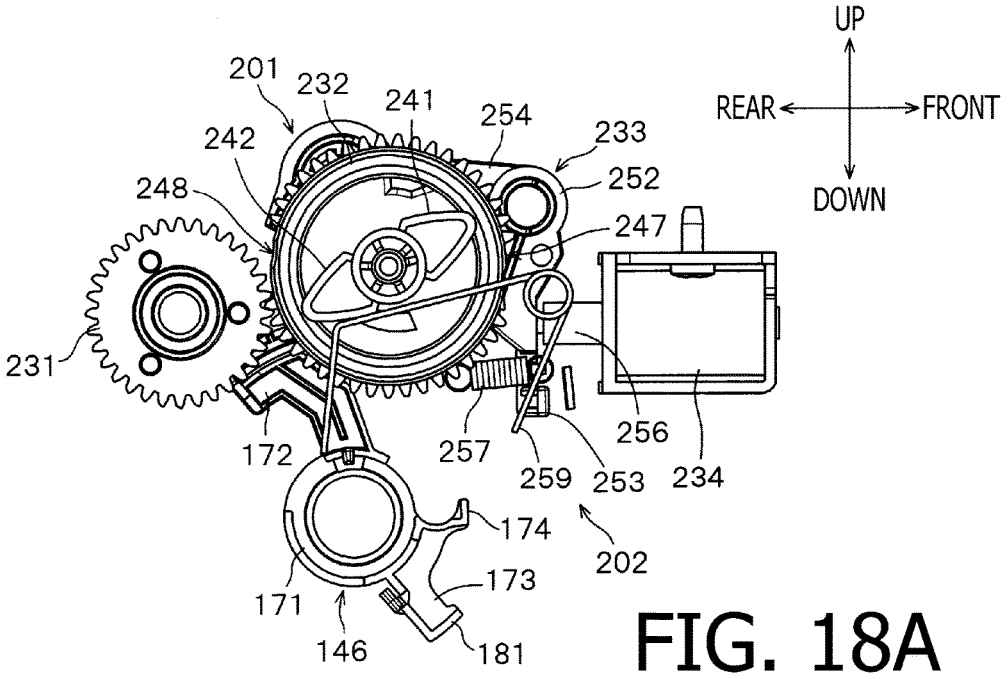
FIG. 18A is a left side view of the switching lever, the toner replenishment lever and the lever driving mechanism, and shows a state immediately after the solenoid was de-energized.
Figure 18B:
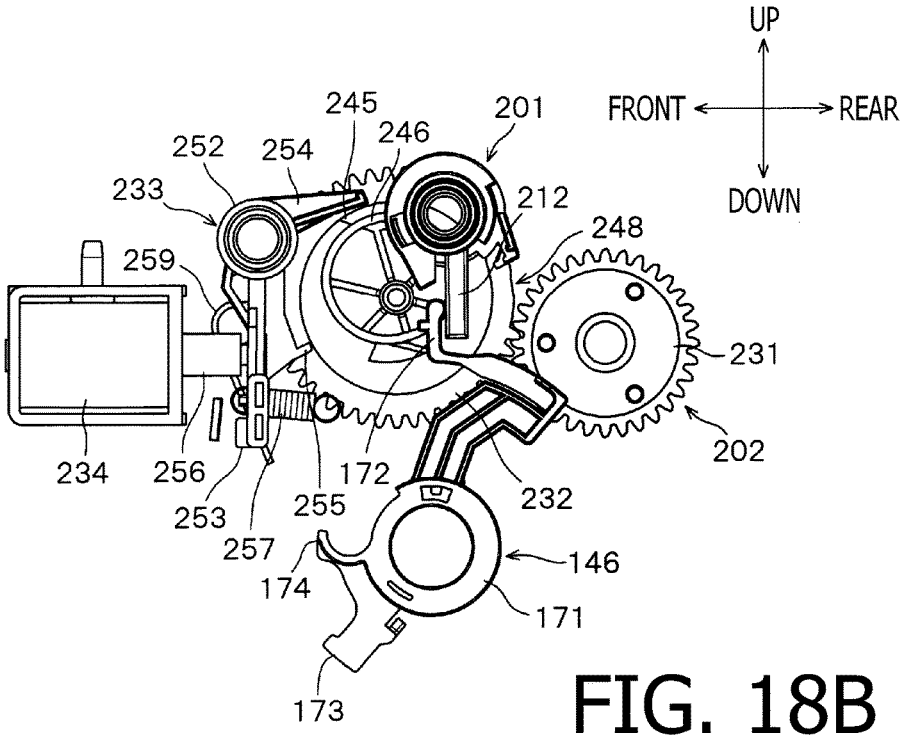
FIG. 18B is a right side view of the switching lever, the toner replenishment lever and the lever driving mechanism, and shows a state immediately after the solenoid was de-energized.

Thereafter, when the solenoid 234 is de-energized, as shown in FIGS. 18A and 18B, the plunger 256 advances from the retracted position to the advanced position due to the elastic force of the coil spring 257. By advancement of the plunger 256, the revolving regulation member 233 rotates counterclockwise in the right side view, the engagement between the second regulating part 254 of the revolving regulation member 232 and the second contacting part 245 of the tooth-lacking gear 232 is released, thereby the tooth-lacking gear 232 becoming rotatable as shown in FIG. 18B. Accordingly, by the urging force of the torsion spring 259, the tooth-lacking gear 232 rotates clockwise in the left side view as shown in FIG. 18A. With this rotation, the tooth-lacking gear 232 engages with the intermediate gear 231, again.

Figure 19A:
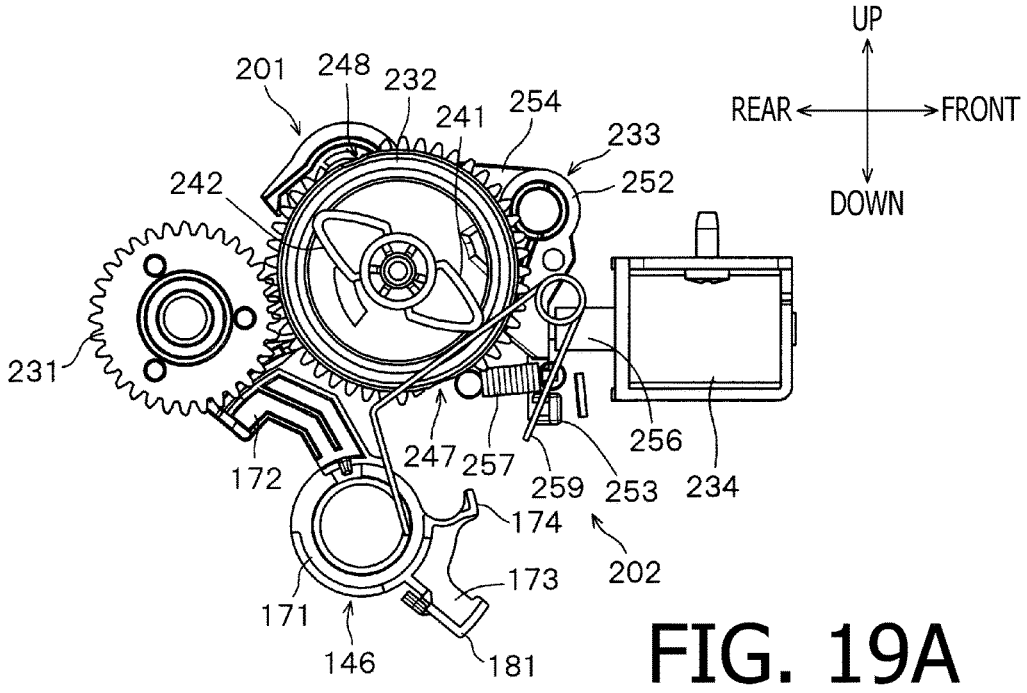
FIG. 19A is a left side view of the switching lever, the toner replenishment lever and the lever driving mechanism, and shows a state after the solenoid was de-energized.
Figure 19B:
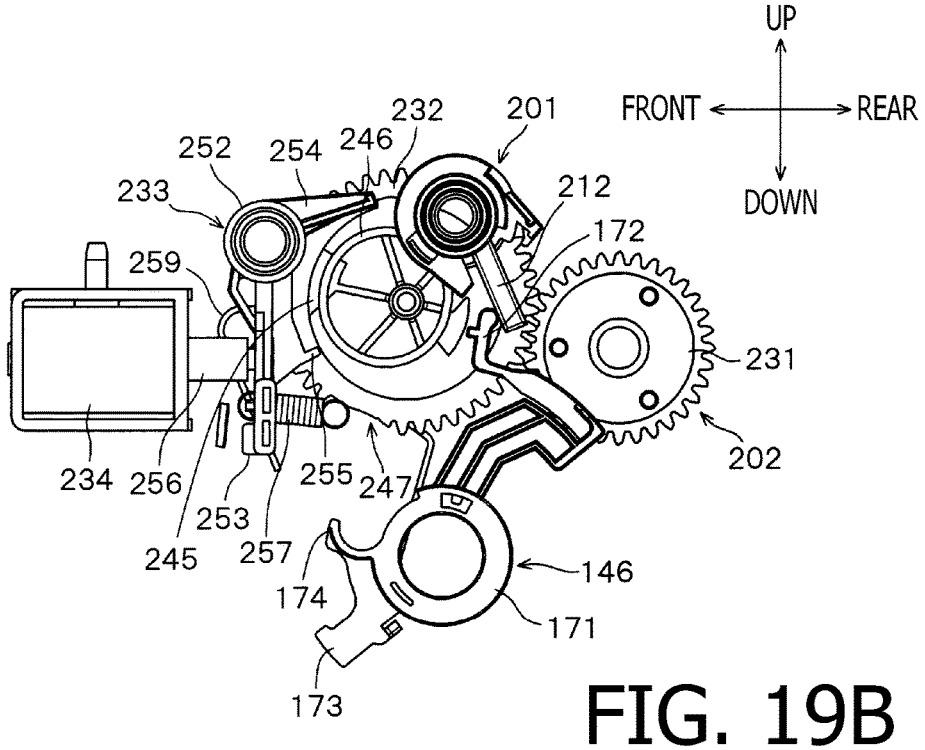
FIG. 19B is a right side view of the switching lever, the toner replenishment lever and the lever driving mechanism, and shows a state after the solenoid was de-energized.

When the intermediate gear 231 engages with the tooth-lacking gear 232, the driving force is transmitted from the intermediate gear 231 to the tooth-lacking gear 232, and the tooth-lacking gear 232 further rotates clockwise in the left side view as shown in FIG. 19A. In association with rotation of the tooth-lacking gear 232, as shown in FIG. 19B, the eccentric cam 246 of the tooth-lacking gear 232 rotates counterclockwise in the right side view, and the revolving operation member 223 of the toner replenishment lever 201 receives the rotating force to rotate the revolving operation member 223 counterclockwise in the right side view from the eccentric cam 24. During rotation of the toner replenishment lever 201 to a position where the contacting part 212 extends from the outer cylinder 211 toward the lower rear side, the contacting part 212 is spaced from the operating part 172 of the switching lever 146, thereby pressing of the operating part 172 by the contacting part 212 being released. Since the pressure is released, the switching lever 146 rotates counterclockwise, in the left side view, to the non-pushed position, and the toner conveying member 129 becomes in the non-driven state.

<Second Frame>

Figure 20:
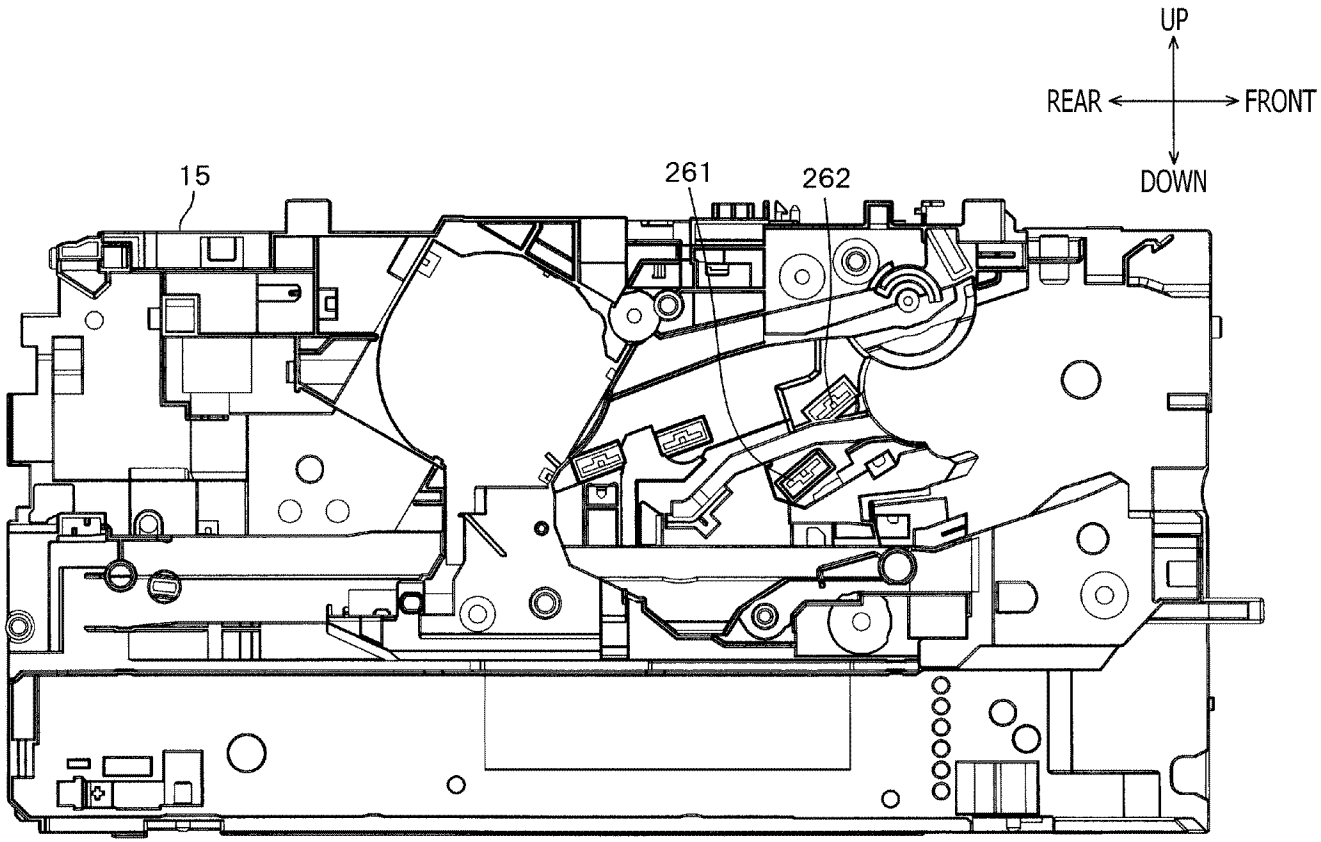
FIG. 20 is a left side view of a second frame.

On the second frame 15, as shown in FIG. 20, a developing bias electrode 261 and a supplying bias electrode 262 are arranged. Each of the developing bias electrode 261 (an example of an elastic member) and the supplying bias electrode 262 (an example of the elastic member) is made of a metal wire which integrally includes a wound part in which the metal wire is helically wound and an annular contact part formed on a left side with respect to the wound part. Further, each of the developing bias electrode 261 and the supplying bias electrode 262 pierces the second frame 15 and protrudes leftward from the left side surface of the second frame 15.

In a state where the process cartridge 41 is attached at the cartridge attachment position P, the contacting part of the developing bias electrode 261 elastically contacts a developing bias terminal 121 (see FIG. 4) of the process cartridge 41. Further, the contacting part of the supplying bias electrode 262 elastically contacts the supplying bias terminal 122 (see FIG. 4) of the process cartridge 41. By the elasticity of the developing bias electrode 261 and the supplying bias electrode 262, the process cartridge 41 is urged leftward, thereby the left end of the drum shaft 101 contacting the right side surface of the first frame 14. As a result, the process cartridge 41 is positioned at the cartridge attachment position P based on the right side surface of the first frame 14.

<Effects>

As described above, the first opening 13 is formed over the front surface 12F and the upper surface 12T of the casing 11. In the casing 11, the first frame 14 and the second frame 15, which are spaced from and faced each other in the right-left direction parallel to the front surface 12F, are provided. At a space sandwiched between the first and second frames 14 and 15, the cartridge attachment position P is defined. The process cartridge 41 is detachably attached to the cartridge attachment position P.

The process cartridge 41 has the developer casing 111 accommodating the photosensitive drum 43, the developing roller 112, the toner box 126, the toner conveying member 129 and the switching lever 146. By operating the switching lever 146, the state of the toner conveying member 129 is switched between the driven state and non-driven state. Specifically, in this case, the state of the conveying member 129 is switched from the non-driven state to the driven state. When the toner conveying member 129 is driven, the toner is supplied from the toner box 126 to the developer casing 111. Further, the toner in the developer casing 111 is supplied to the photosensitive drum 43 by the developing roller 112, the electrostatic latent image on the circumferential surface of the photosensitive drum 43 is developed to the toner image.

To the first frame 14, the toner replenishment lever 201 having the contacting part 212 is provided so as to be movable between the contact position and the spaced position. When the toner replenishment lever 201 is located at the contact position, the contacting part 212 pushes the switching lever 146. Then, the driving state and the non-driving state of the toner conveying member 129 is switched. When the toner conveying member 129 is driven, the toner is conveyed from the toner box 126 to the developer casing 111. When the toner replenishment lever 201 is located at the spaced position, the contacting part 212 is spaced from the switching lever 146, and the contacting part 212 is retracted at the upper position of the space S through which the process cartridge 41 passes when attached to or detached from the cartridge attachment position P. With this configuration, therefore, the contacting part 212 does not block the attachment/detachment movement of the process cartridge 41 with respect to the cartridge attachment position P.

That is, by means of a configuration which does not block the attachment/detachment movement of the process cartridge 41, the state of the toner conveying member 129 can be switched between the driven state and the non-driven state.

The toner replenishment lever 201 rotates above the rotational axis extending in the right-left direction between the contact position and the spaced position. The toner replenishment lever 201 is configured to move frontward such that the contacting part 212 pushes the process cartridge 41 from the cartridge attachment position P toward the first opening 13 when the toner replenishment lever 201 moves from the spaced position to the contact position. Therefore, even if an error has occurred such that the toner replenishment lever 121 does not return from the contact position to the spaced position, it is possible to suppress the toner replenishment lever 201 from blocking the attachment/detachment movement of the process cartridge 41.

Further, the positioning of the process cartridge 41 at the cartridge attachment position P is done based on the right side surface of the first frame 41 as the process cartridge 41 is urged leftward by the elasticity of the developing bias electrode 261 and the supplying bias electrode 262. Further, the toner replenishment lever 201 is provided to the first frame 41. Therefore, when the toner replenishment lever 201 is moved from the spaced position to the contact position, the switching lever 146 can be pressed by the contacting part 212 without fail, and the state of the toner conveying member 129 from the non-driven state to the driven state can be switched without fail.

The toner replenishment lever 201 includes the first revolving member 203, the second revolving member 204 and the torsion spring 205. The contacting part 212 is provided to the first revolving member 203. To the second revolving member 204, a force moving the toner replenishment lever 201 between the contact position and the spaced position is input. Further, the first revolving member 203 and the second revolving member 204 are connected by the torsion spring 205 so as to be rotatable relative to each other within a particular range. Therefore, even if an error has occurred such that the toner replenishment lever 121 does not return from the contact position to the spaced position, it is possible to push to move the contacting part 212 of the toner replenishment lever 201 rearward, and it is possible to suppress the toner replenishment lever 201 from blocking the attachment movement of the process cartridge 41.

<Modifications>

An exemplary embodiment is described above. It is noted that aspects of the present disclosures need not be limited to the above-described configuration, but may be embodied by various ways.

For example, in the above-described embodiment, the printer 1 is explained as an example of the image forming apparatus. It is noted that the image forming apparatus to which the aspects of the present disclosures can be applied should not be limited to the printer 1, but may include various other apparatuses/devices such as a facsimile device or an MFP having an image forming function and an image reading function.

Further, to the above described configurations, various modifications may be applied without departing from the aspects of the present disclosures.

What is claimed is:

1. An image forming apparatus, comprising:

a casing having a first opening on a side surface of the casing;

a first frame and a second frame, both arranged inside the casing;

a cartridge configured to be attached to and detached from, through the first opening, an attachment position defined between the first frame and the second frame, the first frame and the second frame facing each other across the attachment position; and a tonner replenishment lever provided to the first frame, wherein the cartridge includes:

a photosensitive drum;

a developing device accommodating a developing roller configured to supply toner onto a surface of the photosensitive drum;

a tonner accommodating part;

a conveying member configured to convey the toner from the tonner accommodating part to the developing device; and a switching lever configured to switch a state of the conveying member between a driven state in which the conveying member conveys the toner, and a non-driven state in which the conveying member does not convey the toner, wherein the toner replenishment lever further comprises a contacting part, the replenishment lever being movable between a first position at which the contacting part pushes the switching lever and a second position at which the contacting part is spaced from the switching lever, wherein, when the toner replenishment lever is at the second position, the contacting part is located outside a space through which the cartridge passes when the cartridge is attached to or detached from the attachment position, and wherein:

when the toner replenishment lever is located at the first position, the contacting part pushes the switching lever to switch the state of the conveying member from the non-driven state to the driven state; and when the toner replenishment lever is located at the second position, the contacting part is spaced from the switching lever to switch the state of the conveying member from the driven state to the non-driven state.

2. The image forming apparatus according to claim 1, wherein the photosensitive drum is arranged to be rotatable about a rotational axis extending in a facing direction along which the first frame and the second frame face each other when the cartridge is attached to the attachment position, and wherein the toner replenishment lever is configured to movable between the first position and the second position by rotation about a rotational axis extending in the facing direction.

3. The image forming apparatus according to claim 1, wherein the toner replenishment lever is configured such that when the toner replenishment lever is moved from the second position to the first position, the contacting part moves in a direction to push the cartridge from the attachment position toward the opening.

4. The image forming apparatus according to claim 1, further comprising an elastic member provided to the second frame and configured to urge the cartridge toward the first frame when the cartridge is attached to the attachment position, wherein the toner replenishment lever is arranged at a position closer to the first frame than the second frame.

5. The image forming apparatus according to claim 1, further comprising an exposure device arranged at a position sandwiched between the first frame and the second frame and configured to expose a surface of the photosensitive drum to light, wherein the toner replenishment lever is arranged at a position sandwiched between the first frame and the second frame, and on the opening side with respect to the exposure device.

6. The image forming apparatus according to claim 1, wherein the toner replenishment lever comprises a first revolving member, a second revolving member and a torsion spring, the contacting member being provided to the first revolving member, a force to move the toner replenishment lever between the first position and the second position being input to the second revolving member, the first revolving member and the second revolving member being connected by the torsion spring so as to be rotatable relative to each other with in a particular range.

7. An image forming apparatus, comprising:

a casing having a first opening on a side surface of the casing;

a first frame and a second frame, both arranged inside the casing;

a cartridge configured to be attached to and detached from, through the first opening, an attachment position defined between the first frame and the second frame, the first frame and the second frame facing each other across the attachment position; and a tonner replenishment lever provided to the first frame, wherein the cartridge includes:

a photosensitive drum;

a developing device accommodating a developing roller configured to supply toner onto a surface of the photosensitive drum;

a tonner accommodating part;

a conveying member configured to convey the toner from the tonner accommodating part to the developing device; and a switching lever configured to switch a state of the conveying member between a driven state in which the conveying member conveys the toner, and a non-driven state in which the conveying member does not convey the toner, wherein the toner replenishment lever further comprises a contacting part, the contacting part being movable between a first position at which the contacting part pushes the switching lever and a second position at which the contacting part is spaced from the switching lever, the contacting part being retracted to outside of a space through which the cartridge passes when the cartridge is attached to or detached from the attachment position, and wherein:

when the contacting part is located at the first position, the contacting part pushes the switching lever to switch the state of the conveying member from the non-driven state to the driven state; and when the contacting part is located at the second position, the contacting part is spaced from the switching lever to switch the conveying member from the driven state to the non-driven state.

* * * * *